US009920557B2

(12) United States Patent
Kim et al.

(10) Patent No.: US 9,920,557 B2
(45) Date of Patent: Mar. 20, 2018

(54) REFRIGERATOR

(71) Applicant: LG ELECTRONICS INC., Seoul (KR)

(72) Inventors: Nami Kim, Seoul (KR); Jaeyoul Lee, Seoul (KR); Sunghun Lee, Seoul (KR); Jindong Kim, Seoul (KR); Jihyun Im, Seoul (KR); Hyunbum Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/898,406

(22) PCT Filed: Jun. 16, 2014

(86) PCT No.: PCT/KR2014/005259

§ 371 (c)(1),
(2) Date: Dec. 14, 2015

(87) PCT Pub. No.: WO2014/200318

PCT Pub. Date: Dec. 18, 2014

(65) Prior Publication Data

US 2016/0145917 A1 May 26, 2016

(30) Foreign Application Priority Data

Jun. 14, 2013 (KR) ..... 10-2013-0068234
Oct. 18, 2013 (KR) ..... 10-2013-0124735

(51) Int. Cl.
*F25D 23/02* (2006.01)
*E05C 19/12* (2006.01)
(Continued)

(52) U.S. Cl.
CPC ..... *E05C 19/12* (2013.01); *E05B 65/0042* (2013.01); *E05C 3/12* (2013.01);
(Continued)

(58) Field of Classification Search
CPC . E05C 3/12; E05C 7/02; E05C 19/026; E05C 19/02; E05C 19/12; E05B 65/0042; F25D 23/025; F25D 23/028; F25D 23/062
(Continued)

(56) References Cited

U.S. PATENT DOCUMENTS 244,645 A 7/1881 Minchin
2,131,680 A * 9/1938 Zahodiakin ..... F25D 23/04 312/242

(Continued)

FOREIGN PATENT DOCUMENTS

CN 201233148 5/2009
CN 202166266 3/2012

(Continued)

OTHER PUBLICATIONS

International Search Report dated Oct. 28, 2014 for Application No. PCT/KR2014/005259, 3 pages.

(Continued)

*Primary Examiner* — James O Hansen
(74) *Attorney, Agent, or Firm* — Fish & Richardson P.C.

(57) ABSTRACT

Disclosed are a fixing device and a refrigerator having the same. The fixing device includes a clasp (400) installed to a first member (12), the clasp having a contact portion (402, 404) defining a plane, and a coupler (500) installed to a second member (100), the coupler serving to fix the second member to the first member to enable selective coupling or release of the second member and the first member. The coupler includes a hook (510) having a protruding tip portion (511) configured to come into contact with the contact portions (402, 404) so as to be caught by the contact portion (404), the hook being rotatable, and an elastic member (52,0) configured to elastically support the hook such that the hook is rotated toward the clasp. A contact
(Continued)

position of the protruding tip portion and the contact portion is spaced apart from a rotation center of the hook by a predetermined distance (d).

15 Claims, 19 Drawing Sheets

(51) Int. Cl.

| | |
|---|---|
| ***E05B 65/00*** | (2006.01) |
| ***E05C 3/12*** | (2006.01) |
| ***E05C 7/02*** | (2006.01) |
| ***E05C 19/02*** | (2006.01) |
| ***F25D 23/06*** | (2006.01) |
| *F25D 23/04* | (2006.01) |

(52) U.S. Cl.
CPC ..... *E05C 7/02* (2013.01); *E05C 19/02* (2013.01); *E05C 19/026* (2013.01); *F25D 23/025* (2013.01); *F25D 23/028* (2013.01); *F25D 23/062* (2013.01); *F25D 23/04* (2013.01); *F25D 2201/10* (2013.01)

(58) Field of Classification Search
USPC ..... 312/401, 405, 405.1, 321.5, 291, 292
See application file for complete search history.

(56) References Cited

U.S. PATENT DOCUMENTS 2,150,064 A * 3/1939 John ..... F25D 23/04 292/169
2,942,438 A * 6/1960 Schmeling ..... F25D 23/025 62/377
3,086,830 A * 4/1963 Peter Malia John ... F25D 23/04 292/31
3,140,134 A * 7/1964 Nairn ..... A47K 5/02 312/204
5,966,963 A * 10/1999 Kovalaske ..... F25D 23/02 312/405
8,147,015 B2 4/2012 Kim
2003/0132690 A1* 7/2003 Shin ..... F25D 23/025 312/405
2008/0278049 A1* 11/2008 Park ..... F25D 23/025 312/405
2008/0303400 A1* 12/2008 Kim ..... F25D 23/02 312/401
2010/0084956 A1* 4/2010 Kim ..... F25D 23/025 312/405.1
2013/0049562 A1* 2/2013 Jung ..... F25D 23/028 312/405

FOREIGN PATENT DOCUMENTS

| | | |
|---|---|---|
| EP | 2 565 565 A2 | 3/2013 |
| FR | 1130891 A | 2/1957 |
| WO | 2009061092 | 5/2009 |

OTHER PUBLICATIONS

Extended European Search Report in European Application No. 14811118.0, dated May 4, 2017, 9 pages (with English translation).

* cited by examiner

[Fig. 1]
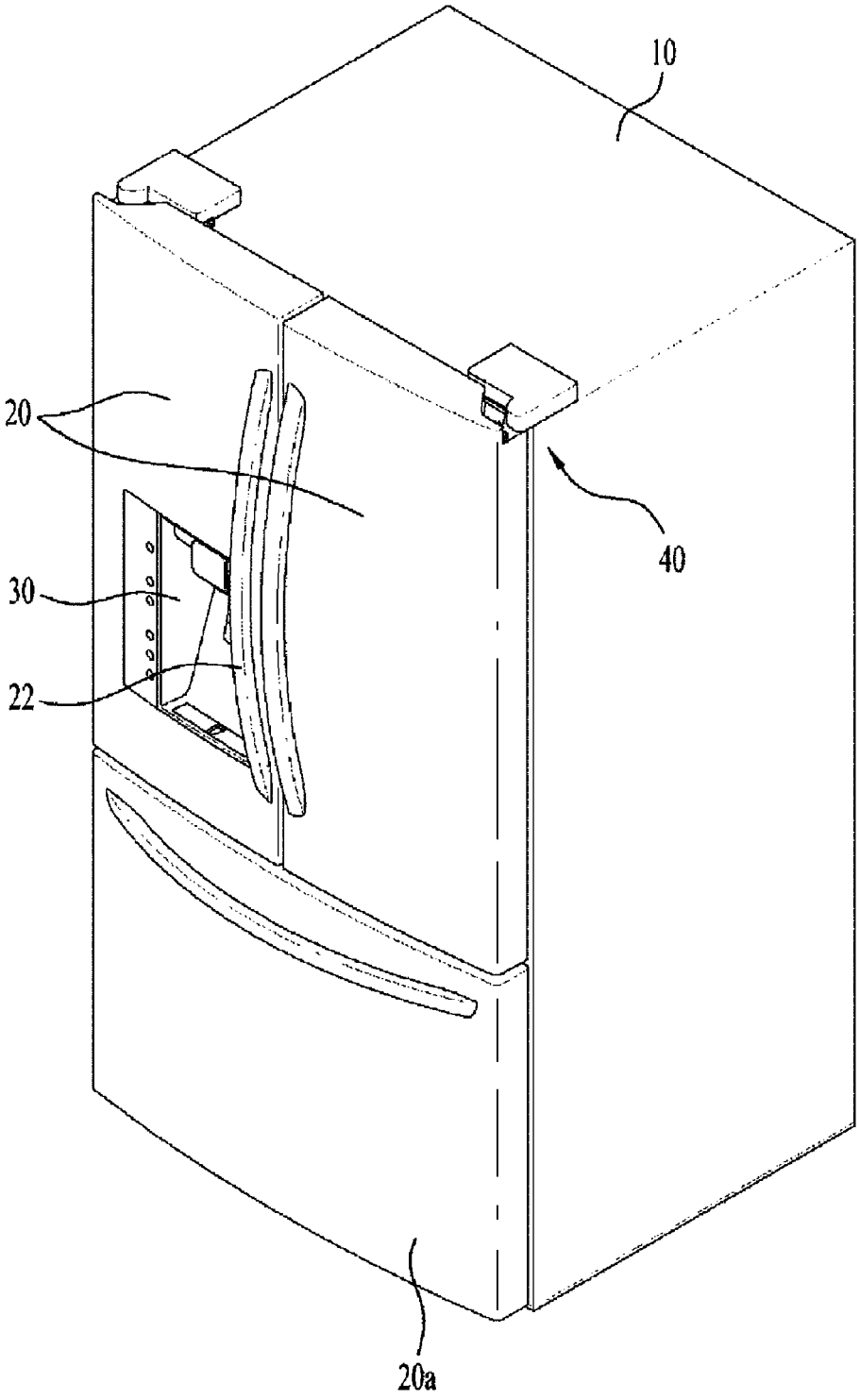

[Fig. 2]
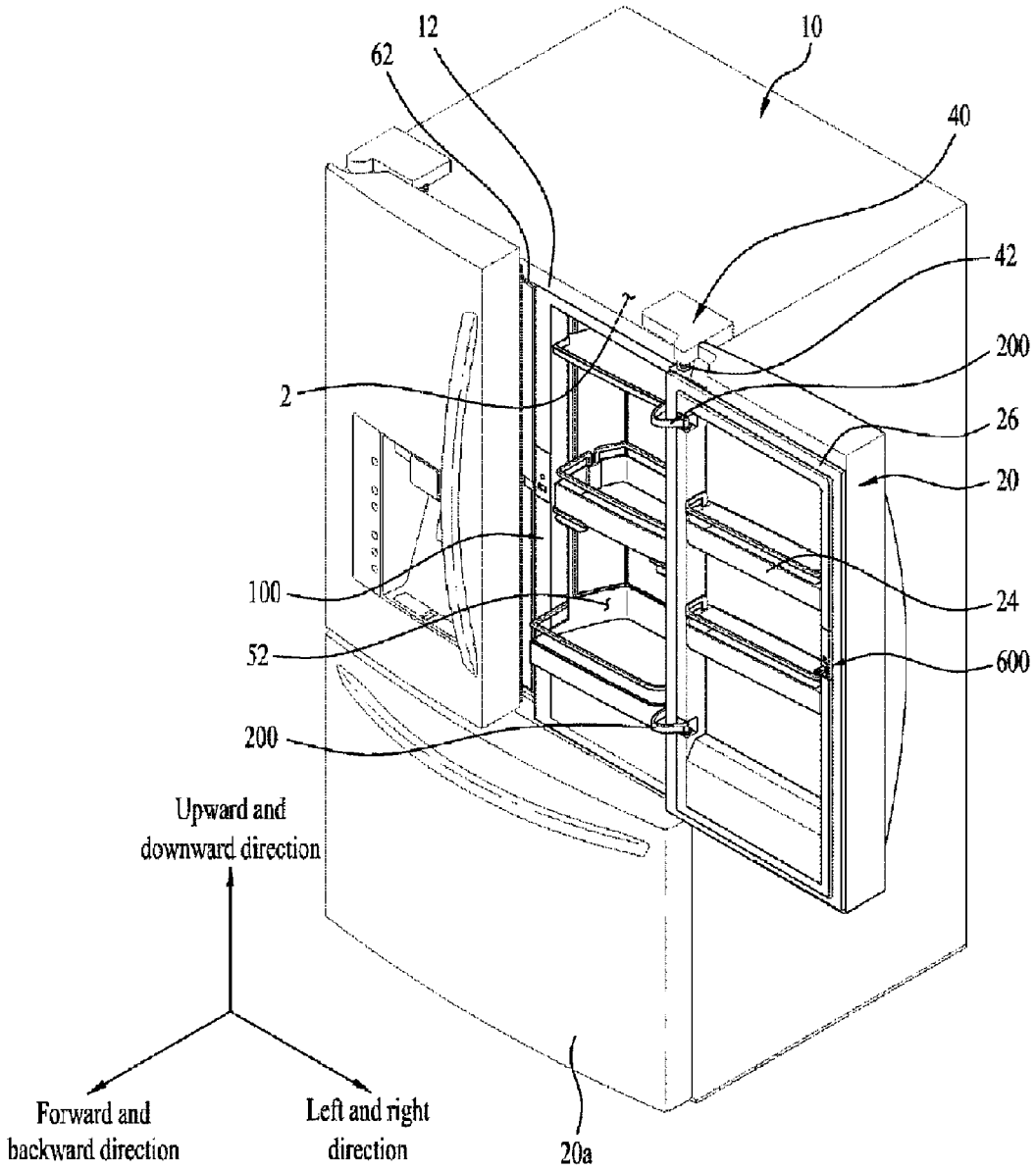

[Fig. 3]
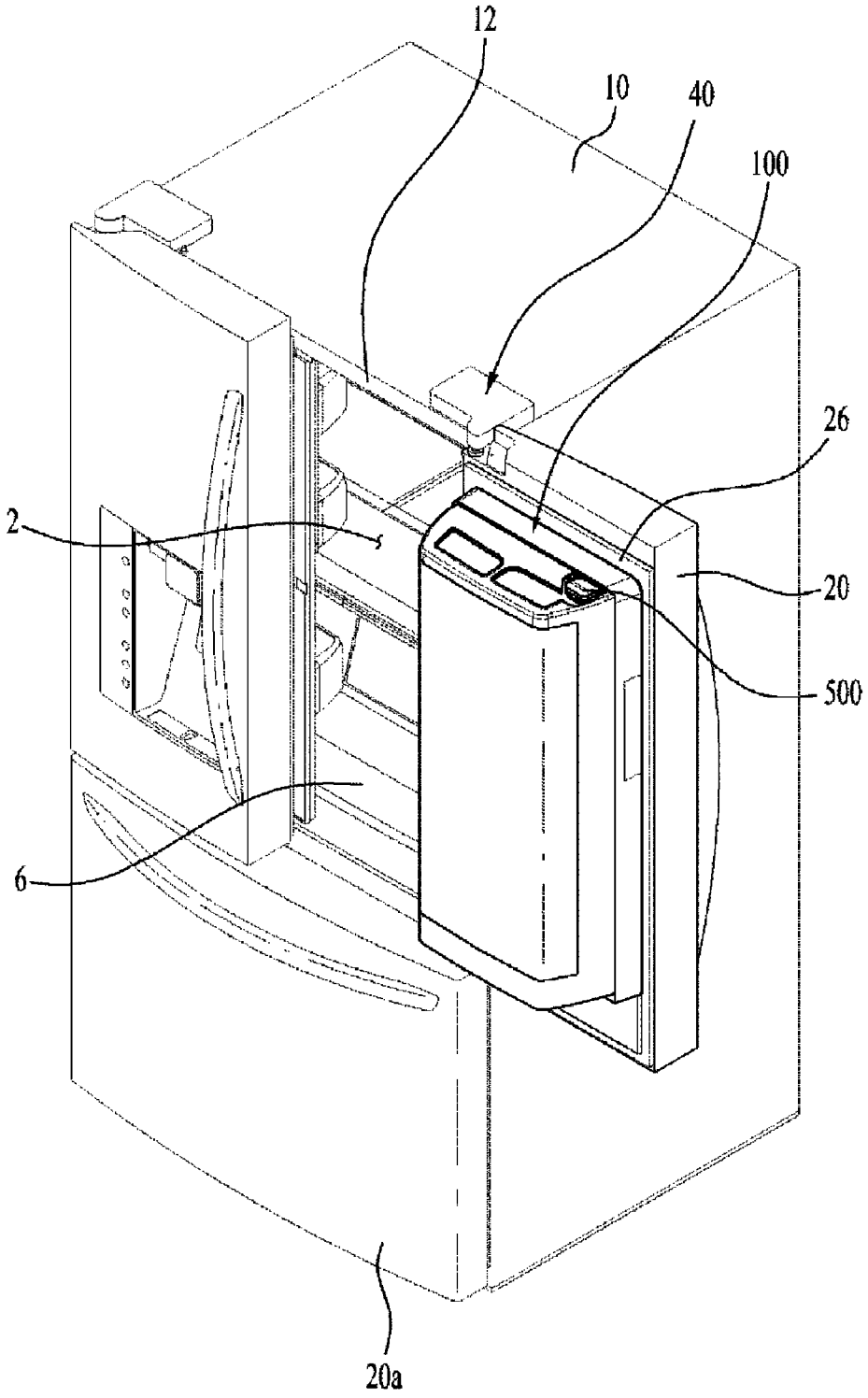

[Fig. 4]
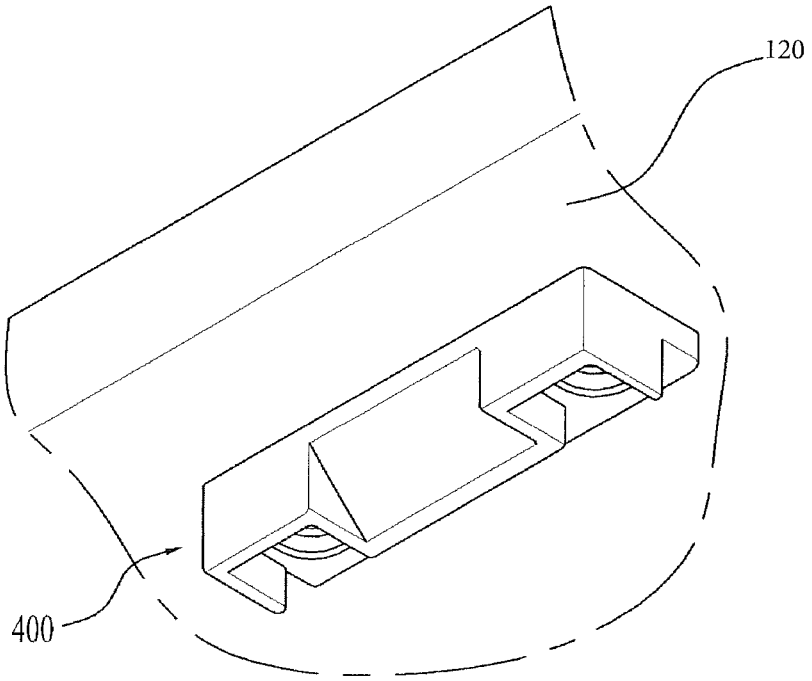

[Fig. 5]
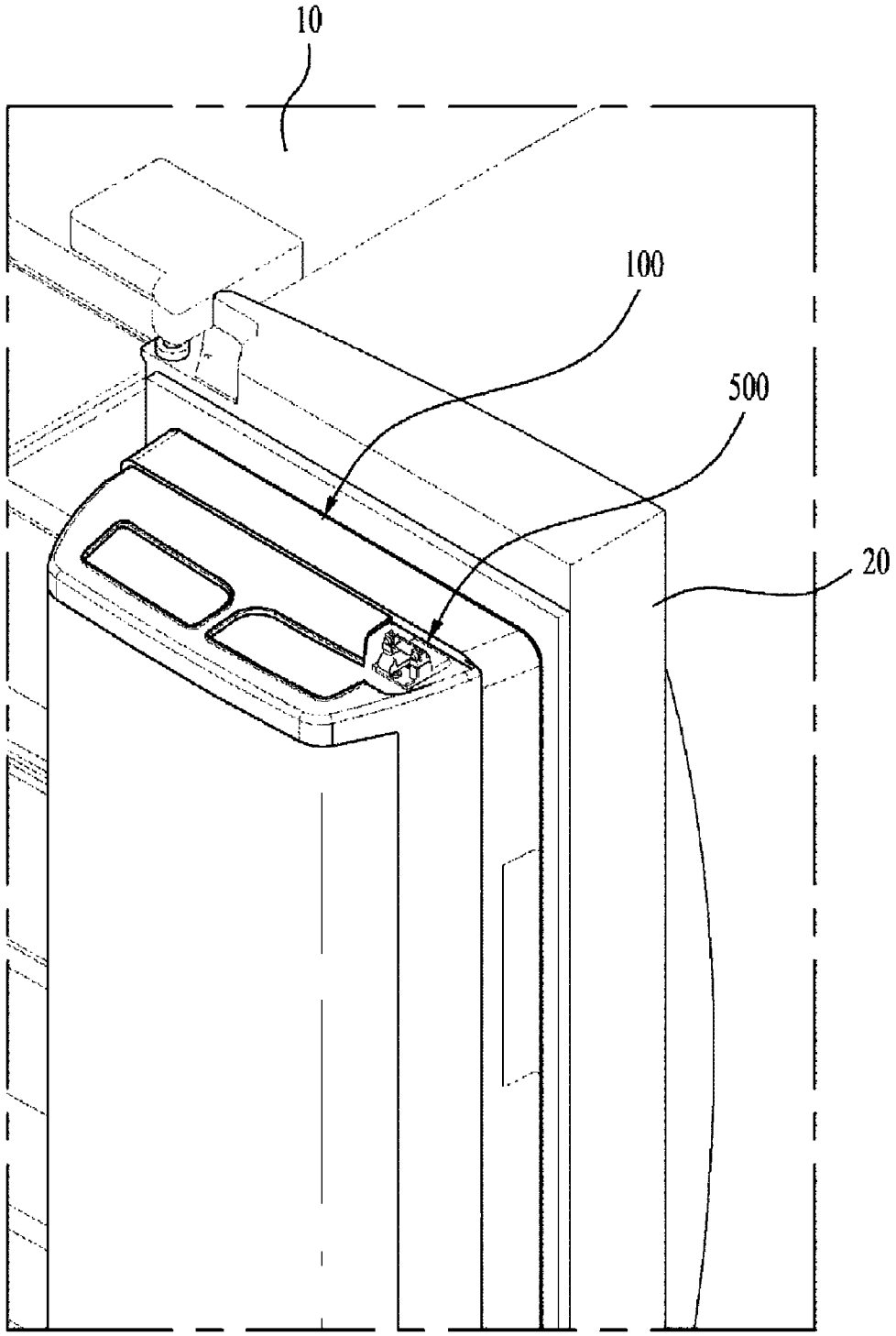

[Fig. 6]
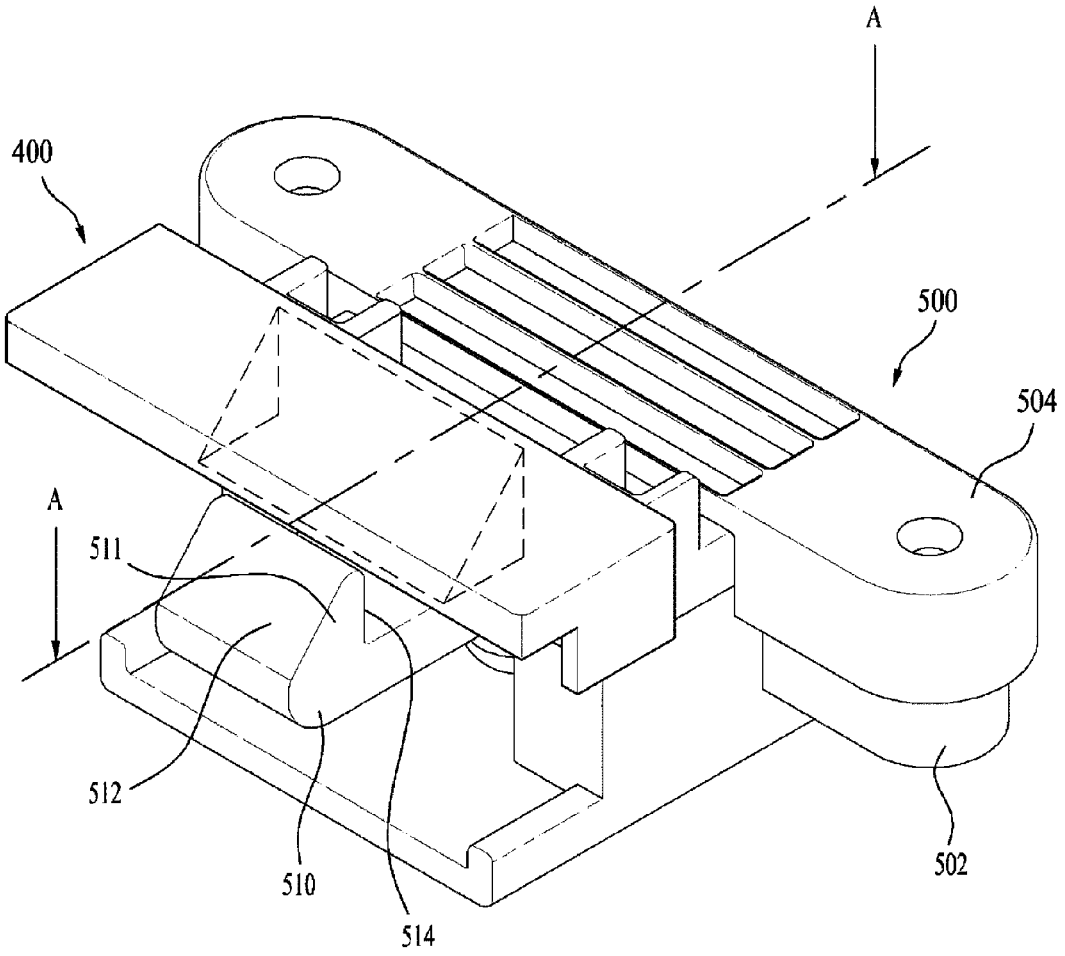

[Fig. 7]
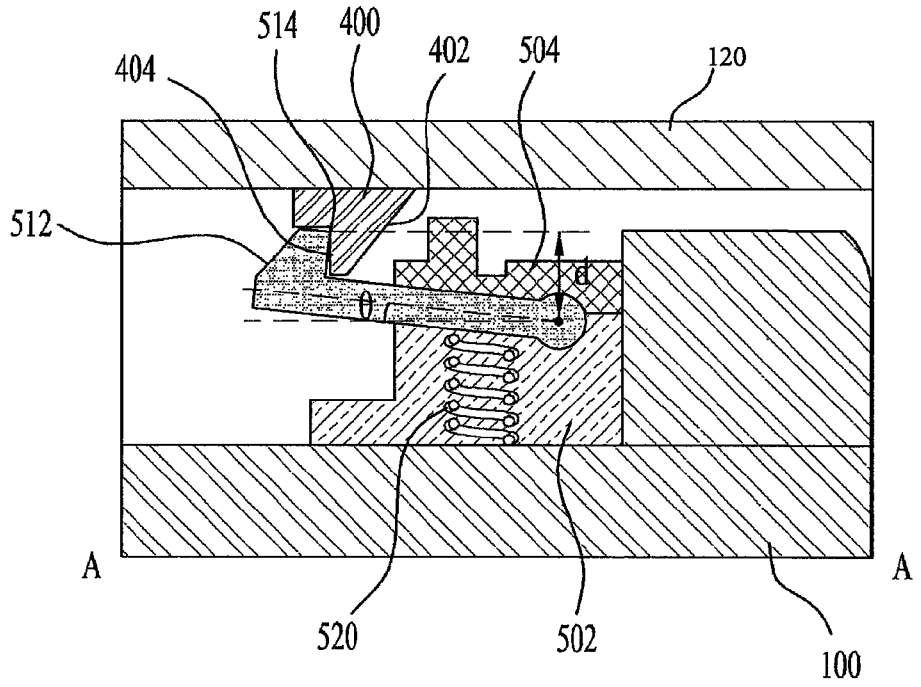
[Fig. 8]
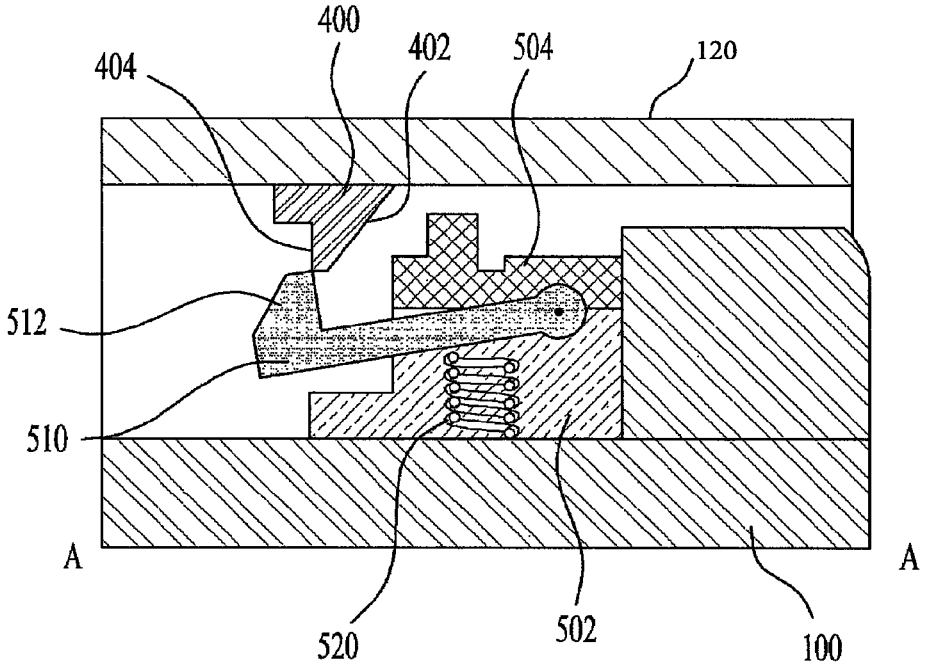

[Fig. 9]
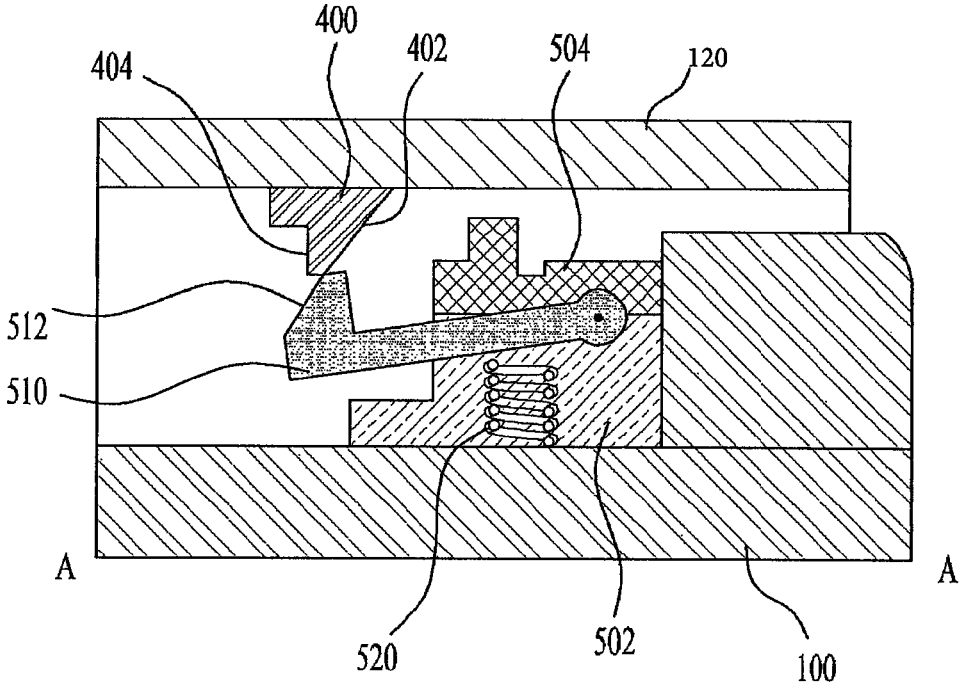
[Fig. 10]
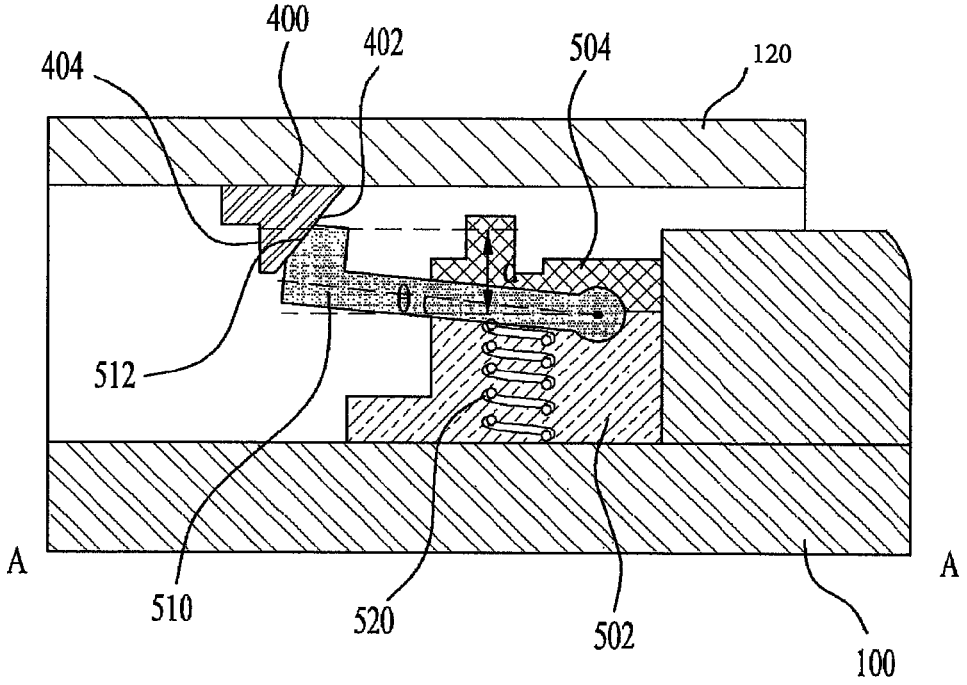

[Fig. 11]
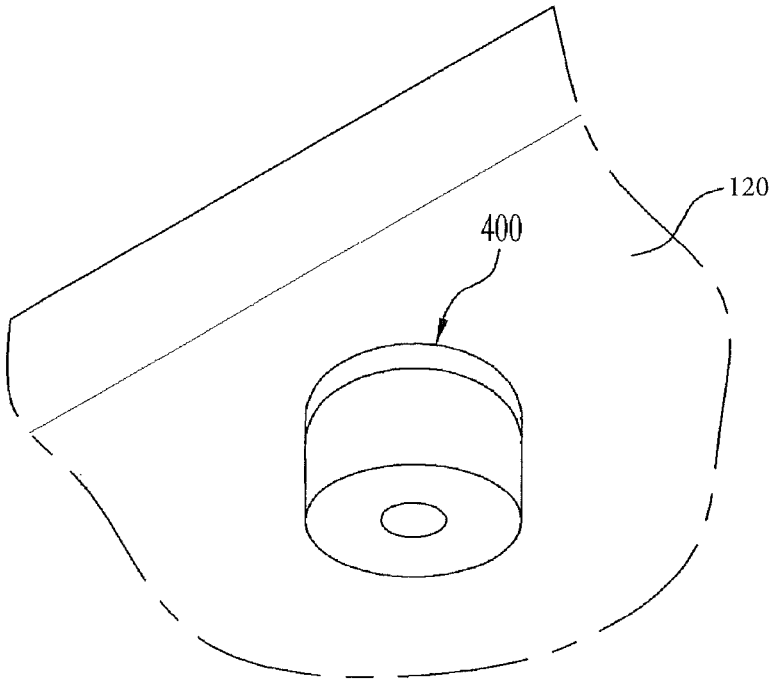

[Fig. 12]
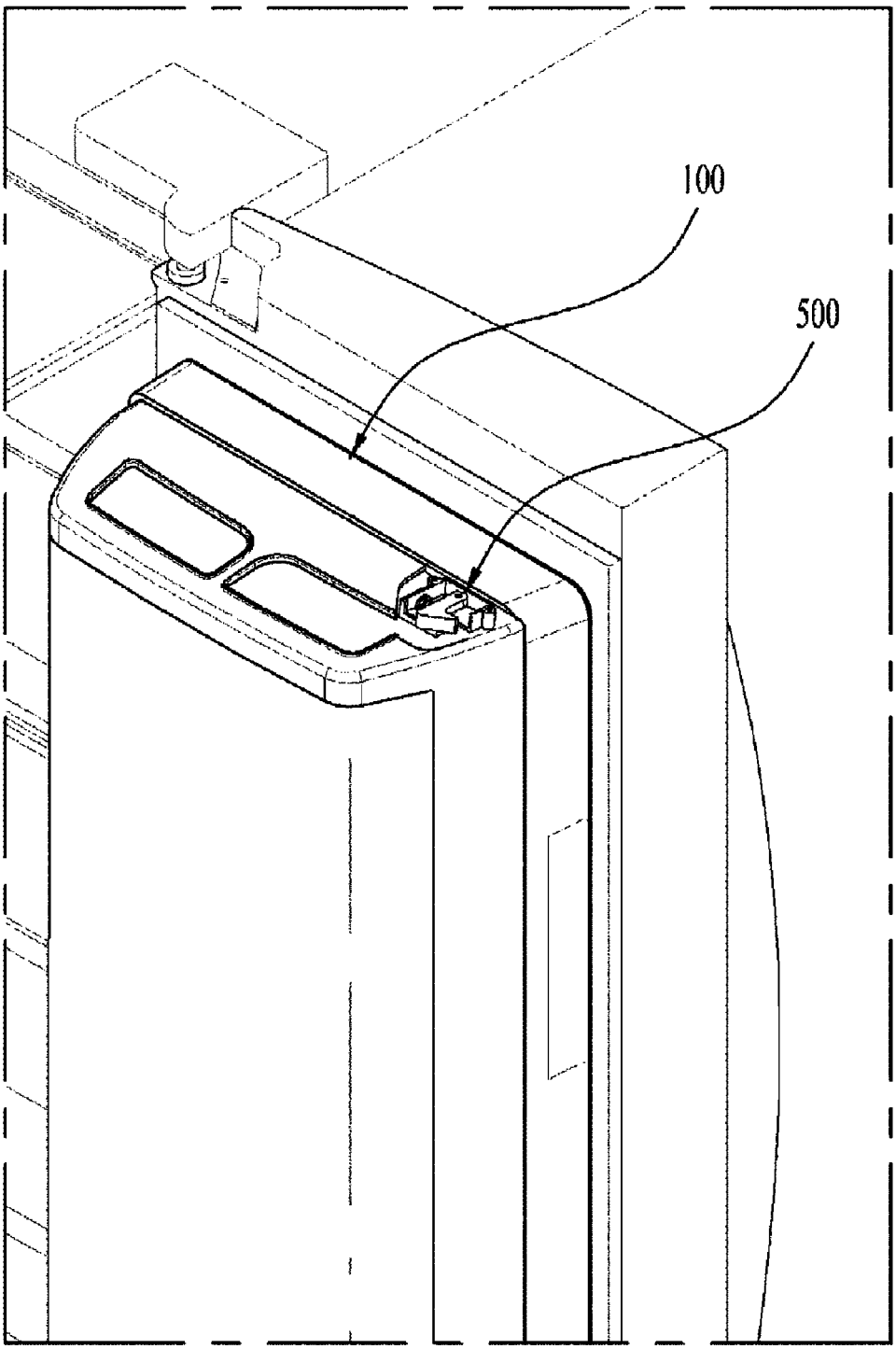

[Fig. 13]
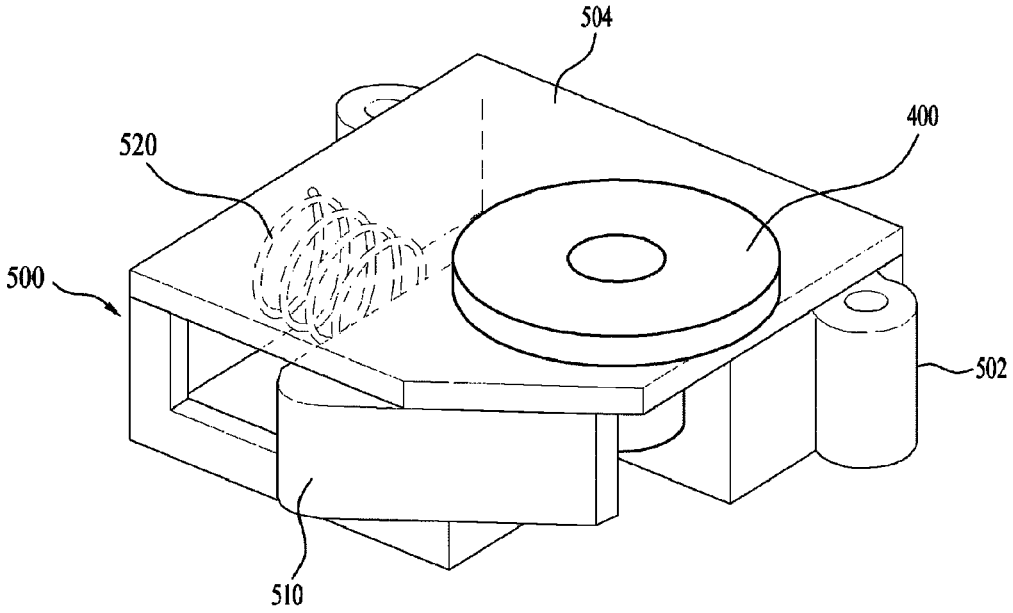
[Fig. 14]
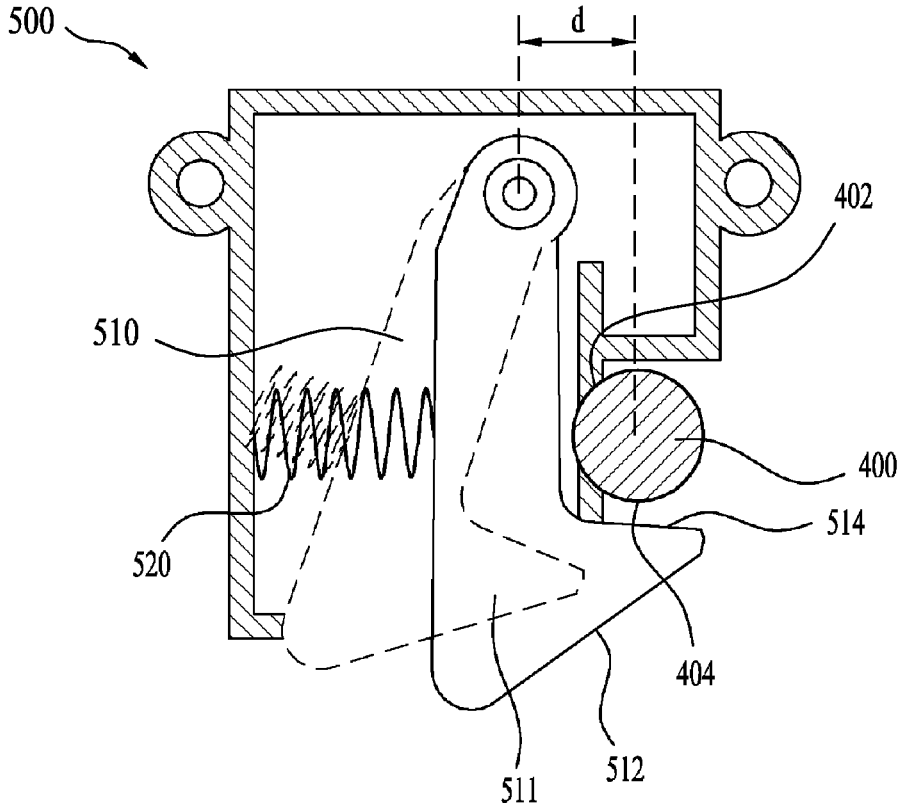

[Fig. 15]
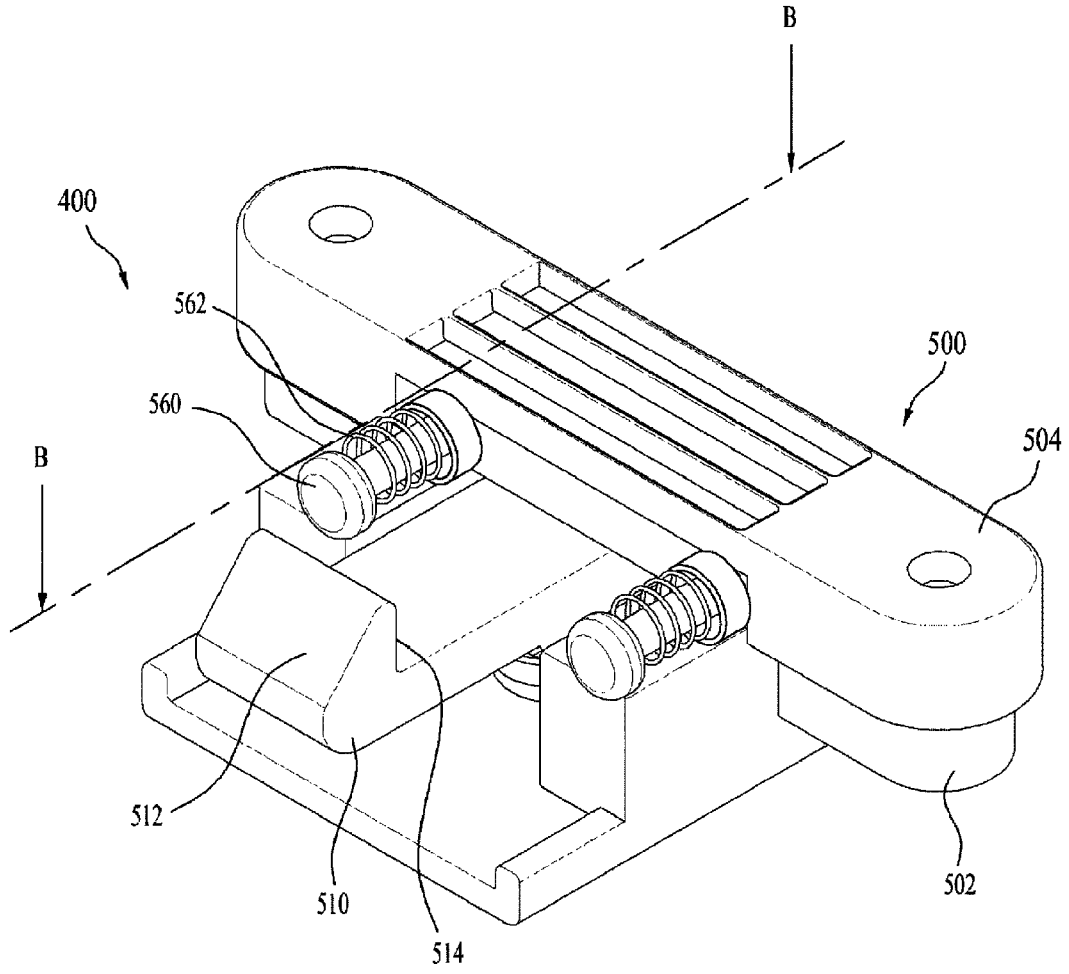

[Fig. 16]
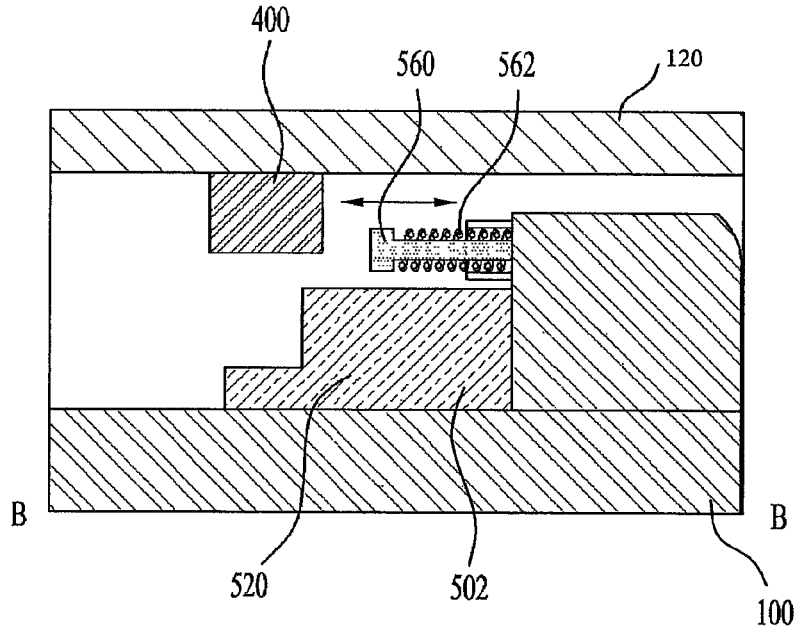
[Fig. 17]
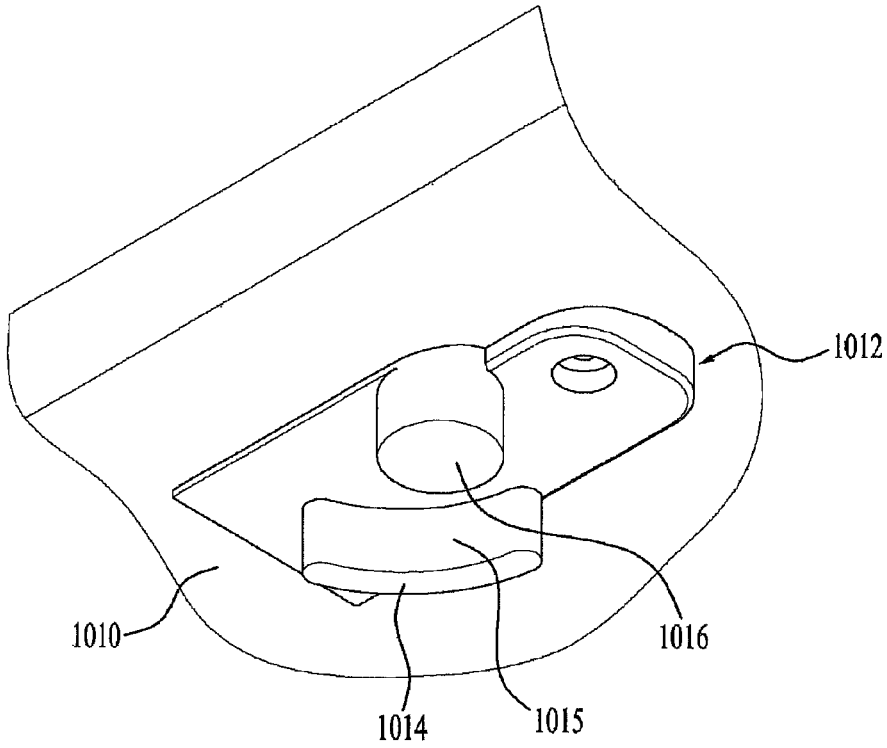

[Fig. 18]
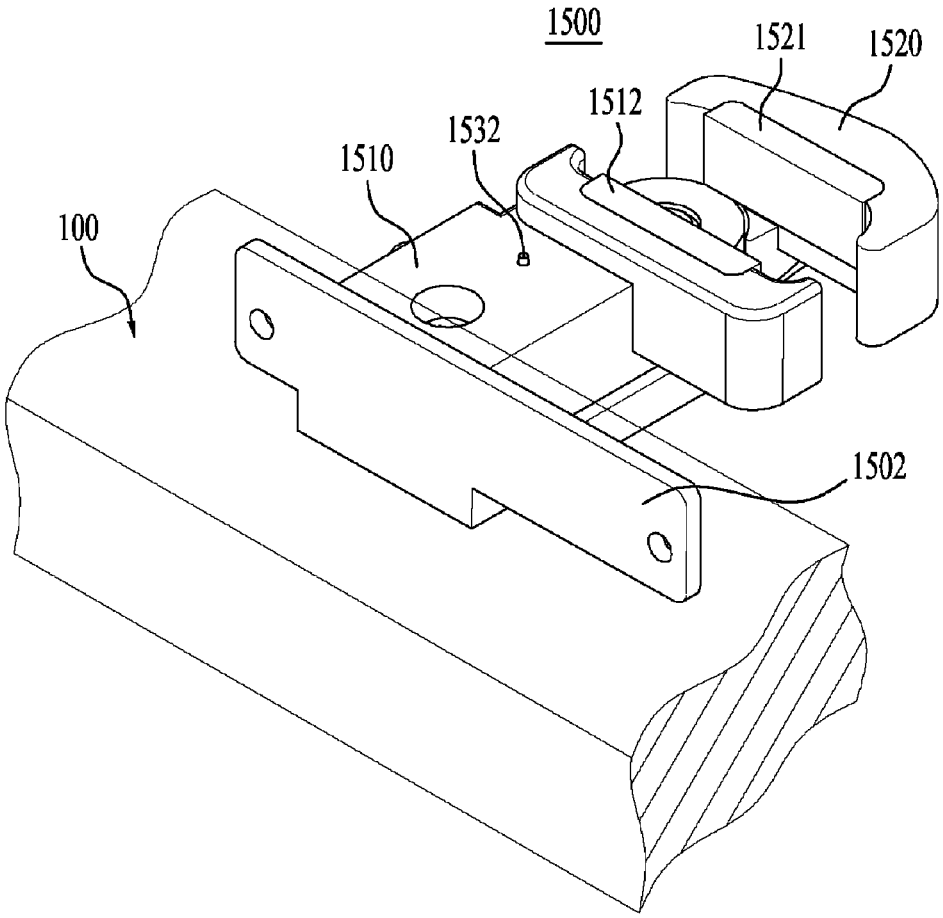
[Fig. 19]
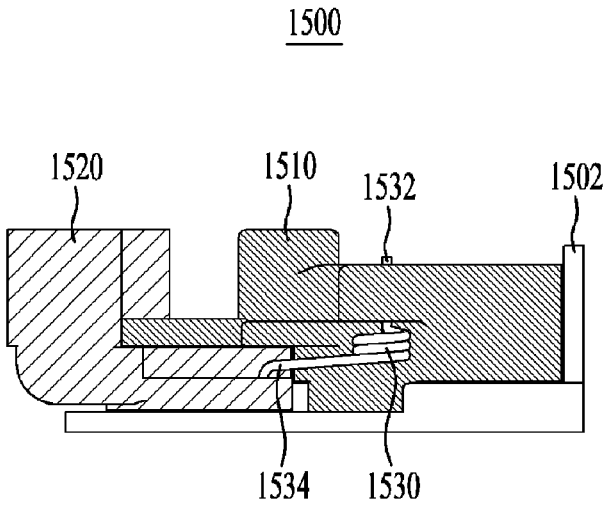

[Fig. 20]
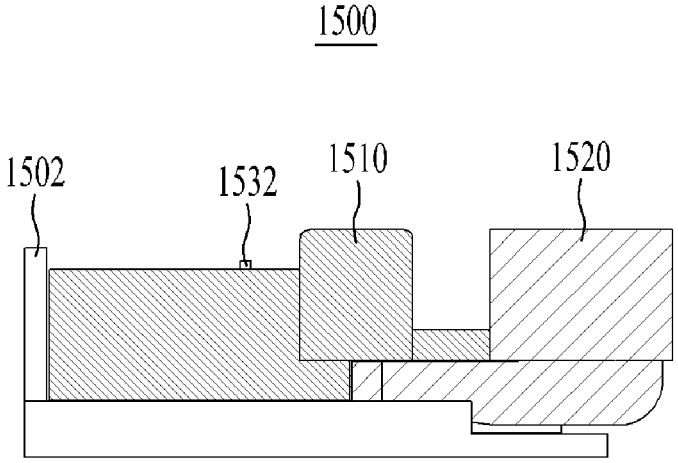

[Fig. 21]
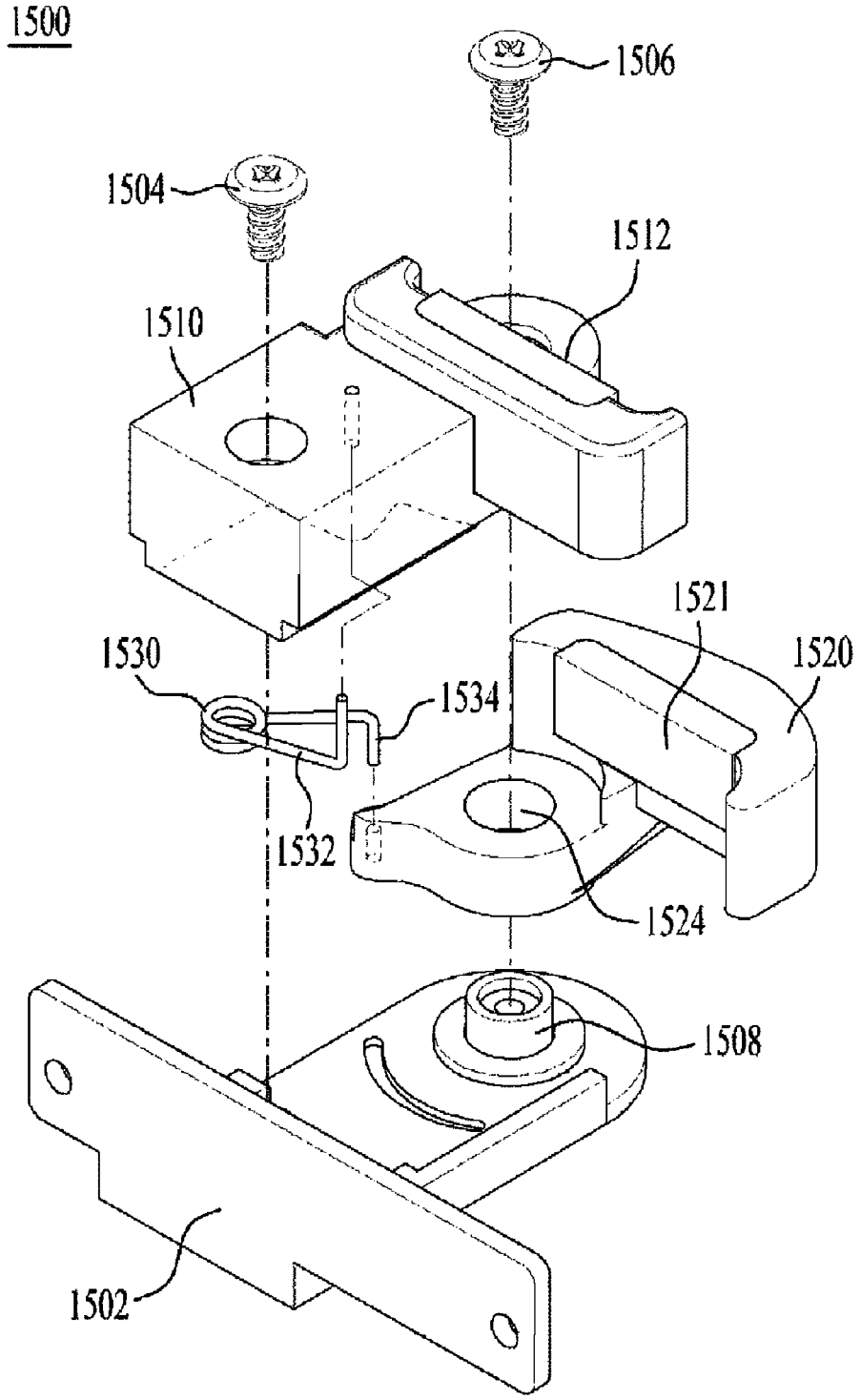

[Fig. 22]
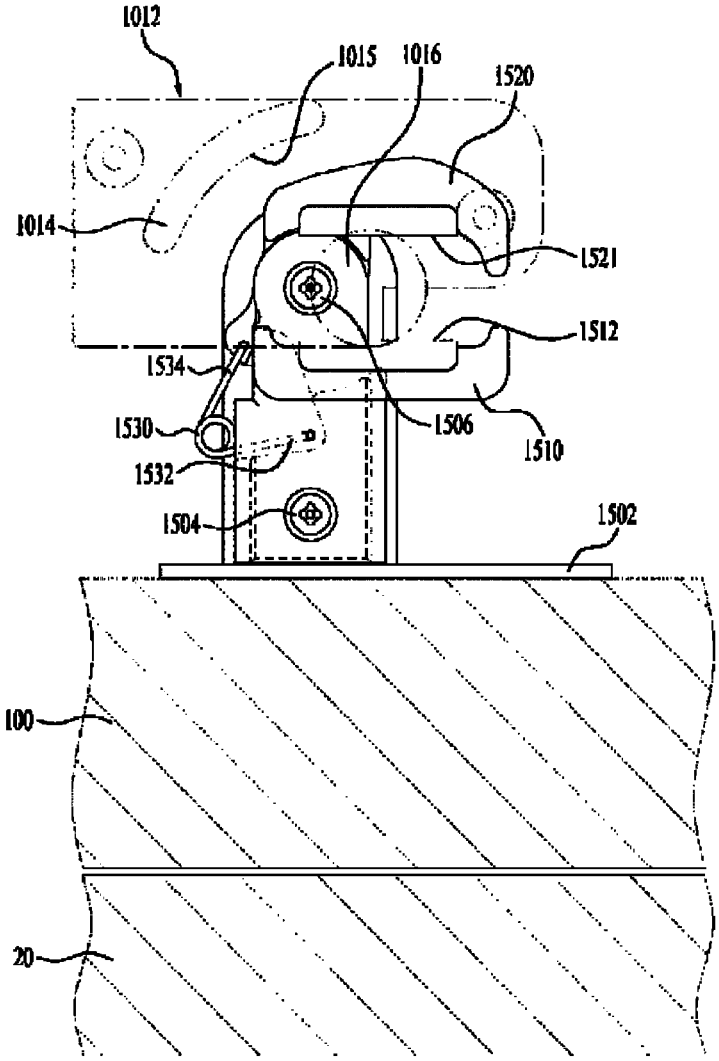

[Fig. 23]
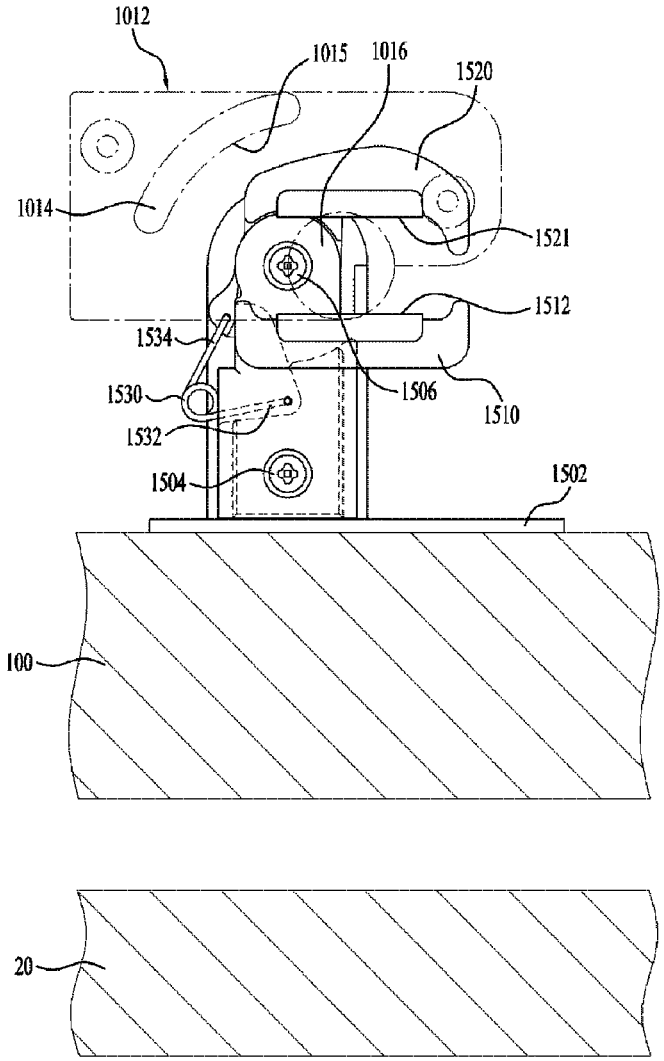

[Fig. 24]
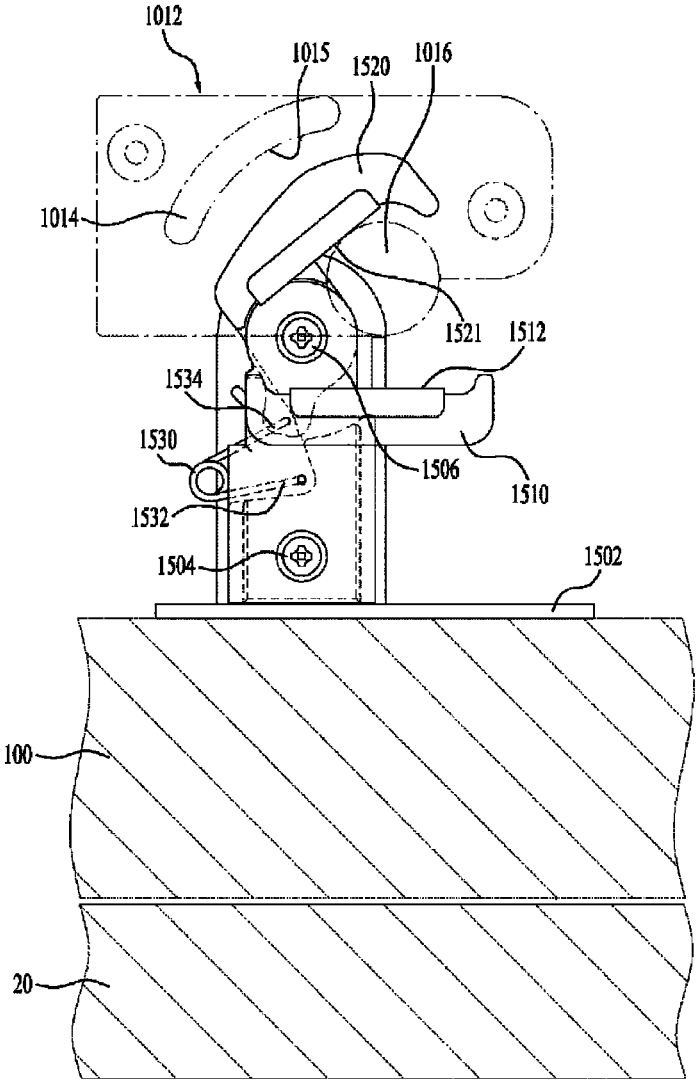

REFRIGERATOR

CROSS REFERENCE TO RELATED APPLICATIONS

This application is a U.S. National Phase Application under 35 U.S.C. § 371 of International Application PCT/KR2014/005259, filed on Jun. 16, 2014, which claims the benefit of Korean Application No. 10-2013-0068234, filed on Jun. 14, 2013 and Korean Application No. 10-2013-0124735, filed on Oct. 18, 2013, the entire contents of which are hereby incorporated by reference in their entireties.

TECHNICAL FIELD

The present invention relates to a fixing device and a refrigerator having the same and, more particularly, to a fixing device for use in a refrigerator which includes an extra storage compartment in addition to a main storage compartment, the fixing device assisting a user in selectively accessing the main storage compartment or the extra storage compartment, and a refrigerating having the same.

BACKGROUND ART

In general, a refrigerator is an apparatus that stores food and the like refrigerated or frozen by keeping a storage compartment defined in the refrigerator at a predetermined temperature using a refrigeration cycle consisting of a compressor, a condenser, an expansion valve and an evaporator. Such a refrigerator generally includes a freezing compartment in which food or beverages are kept frozen and a refrigerating compartment in which food or beverages are kept at a low temperature.

Refrigerators may be classified based on positions of the freezing compartment and the refrigerating compartment. For example, refrigerators may be classified into a top mount type refrigerator in which the freezing compartment is located above the refrigerating compartment, a bottom freezer type refrigerator in which the freezing compartment is located below the refrigerating compartment and a side by side type refrigerator in which the freezing compartment and the refrigerating compartment are left and right compartments divided by a partition.

In recent years, refrigerators to satisfy various consumer demands and to prevent loss of cold air caused by frequent door opening/closing have been proposed. For example, a refrigerator, which includes an extra storage space (hereinafter referred to as "auxiliary storage compartment" for convenience) in addition to a main storage compartment and allows a user to access the auxiliary storage compartment without opening a door of the refrigerator, has been proposed.

Accordingly, studies related to a device to allow a user to selectively access the main storage compartment or the auxiliary storage compartment of the refrigerator have been conducted.

DISCLOSURE OF INVENTION

Technical Problem

The present invention is directed to solving the above-described problems and one object of the present invention is to provide a fixing device which selectively couples two members to each other and permits release of coupling of the two members only when force of a given magnitude or more is applied.

Another object of the present invention is to provide a refrigerator in which a door and a container may be simultaneously or individually rotated according to user convenience.

Solution to Problem

In accordance with one embodiment of the present invention, there is provided a fixing device including a coupler having a hook provided with a protruding tip portion and a clasp providing a surface configured to be caught by the coupler, the fixing device serving to couple two members or release coupling of the two members.

In the present invention, since a predetermined distance is present between a portion for transfer of horizontal force between the coupler and the clasp and a rotation center of the hook, the hook may be rotated by horizontal force to release coupling of the two members.

In accordance with another embodiment of the present invention, there is provided a fixing device including a clasp installed to a first member, the clasp having a contact portion defining a plane and a coupler installed to a second member, the coupler serving to fix the second member to the first member to enable selective coupling or release of the second member and the first member, wherein the coupler includes a hook having a protruding tip portion configured to come into contact with the contact portion so as to be caught by the contact portion, the hook being rotatable and an elastic member configured to elastically support the hook such that the hook is rotated toward the clasp, and wherein a contact position of the protruding tip portion and the contact portion is spaced apart from a rotation center of the hook by a predetermined distance.

The elastic member may be pushed when force of a given magnitude or more is horizontally applied to the hook, thereby causing the hook to be rotated about the rotation center of the hook.

The contact position of the protruding tip portion and the contact portion may be located higher than the rotation center of the hook by a predetermined distance.

The hook may be arranged so as to be tilted upward relative to a horizontal direction by a predetermined angle.

The coupler may include a damper member configured to absorb shock caused via contact with the first member.

The protruding tip portion may include a first slope configured to come into contact with the clasp when the protruding tip portion begins to be caught by the clasp and a second slope configured to come into contact with the clasp when the protruding tip portion is released from the clasp.

Meanwhile, the first slope and the second slope may have different inclination angles.

In particular, the contact portion may include a first contact portion configured to come into contact with the hook when the hook begins to be caught by the clasp and a second contact portion configured to come into contact with the hook when the hook begins to be released from the clasp.

The first contact portion and the second contact portion may have different inclination angles.

In accordance with a further embodiment of the present invention, there is provided a refrigerator including a cabinet configured to define a first storage region in which food is stored, a door rotatably connected to a first rotating shaft via a first hinge member to open or close the first storage region, the first rotating shaft being located at the front of the cabinet, a gasket provided at the door, a container configured to define a second storage region, the second storage region being received in the first storage region, the container being rotatably connected to a second rotating shaft via a second hinge member, the second rotating shaft being located at the door and a fixing device configured to selectively fix the container to the cabinet, wherein the fixing device includes a clasp installed to the cabinet, the clasp having a contact portion defining a plane and a coupler installed to the container, wherein the coupler includes a hook having a protruding tip portion configured to come into contact with the contact portion so as to be caught by the contact portion, the hook being rotatable and an elastic member configured to elastically support the hook such that the hook is rotated toward the clasp, and wherein a contact position of the protruding tip portion and the contact portion is spaced apart from a rotation center of the hook by a predetermined distance.

In particular, the fixing device may release the container from the cabinet when the container and the door are rotated together via the first hinge member.

The fixing device may release the container from the cabinet when the container and the door are coupled to each other and are rotated together.

The fixing device may continuously couple the container to the cabinet when the door is rotated in a state in which coupling of the door and the container is released.

Meanwhile, the clasp may be located at the top of the first storage region, and the coupler may be located at the top of the container.

The coupler may be installed to the container at a position opposite to an installation position of the second hinge member.

Advantageous Effects of Invention

Effects of the present invention as described above are as follows.

Firstly, according to the present invention, by allowing coupling of two members to be released when force of a given magnitude or more is applied, it is possible to allow a user to easily select whether or not to couple the two members or to release coupling of the two members.

Secondly, according to the present invention, the user may rotate a door alone when it is desired to access a container having an auxiliary storage compartment and may rotate the container and the door together when it is desired to use a freezing compartment or a refrigerating compartment, which may ensure enhanced user convenience.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing an embodiment of a refrigerator according to the present invention;

FIG. 2 is a perspective view showing a state in which a door of the refrigerator shown in FIG. 1 is opened alone;

FIG. 3 is a perspective view showing a state in which a container and the door of the refrigerator shown in FIG. 1 are opened;

FIG. 4 is a view showing a clasp of a fixing device according to one embodiment of the present invention;

FIG. 5 is a view showing a state in which a coupler according to one embodiment of the present invention is installed to the container;

FIG. 6 is a view showing the clasp and the coupler according to one embodiment of the present invention;

FIGS. 7 to 10 are views showing operation according to one embodiment;

FIG. 11 is a view showing a clasp according to another embodiment of the present invention;

FIG. 12 is a view showing a state in which a coupler according to another embodiment of the present invention is installed to the container;

FIG. 13 is a view showing the clasp and the coupler according to another embodiment of the present invention;

FIG. 14 is a view showing operation according to another embodiment;

FIG. 15 is a view showing a coupler according to an alternative embodiment of the present invention;

FIG. 16 is a view explaining operation of FIG. 15;

FIG. 17 is a view showing a clasp of a fixing device according to a further embodiment of the present invention;

FIG. 18 is a view showing a coupler according to a further embodiment;

FIG. 19 is a left side view of FIG. 18;

FIG. 20 is a right side view of FIG. 18;

FIG. 21 is an exploded perspective view of FIG. 18;

FIG. 22 is a view showing operation of the fixing device in the state of FIG. 1 according to a further embodiment;

FIG. 23 is a view showing operation of the fixing device in the state of FIG. 2 according to a further embodiment; and FIG. 24 is a view showing operation of the fixing device in the state of FIG. 3 according to a further embodiment.

BEST MODE FOR CARRYING OUT THE INVENTION

Hereinafter, preferred embodiments of the present invention to concretely achieve the above-described objects will be described with reference to the accompanying drawings.

The size, shape or the like of components shown in the drawings may be exaggerated for clarity and convenience of description. In addition, the terms, particularly defined by taking into consideration the configurations and functions of the present invention, may be replaced by other terms based on intensions of users or operators or customs. Hence, the meanings of these terms must follow definitions described in the entire specification.

In FIG. 1, a storage compartment in which food and the like may be stored, for example, a refrigerating compartment is defined in a cabinet 10 and a freezing compartment is also defined below the refrigerating compartment. To open or close the refrigerating compartment, a door 20 is rotatably installed to an upper portion of the cabinet 10 via a hinge member 40 (hereinafter referred to as "first hinge member" for convenience). Although the present embodiment illustrates two doors 20 to open or close the refrigerating compartment, it will be appreciated that the present embodiment is not limited thereto and a single door may be used. The door 20 is provided with a handle 22 to assist a user in pivotally rotating the door 20. Of course, the shape or structure of the handle 22 is not limited to illustration of the drawing and various other structures may be selected.

A dispenser 30 may be installed in the door 20 to provide the user with water or ice. An additional door 20*a* may be installed to a lower portion of the cabinet 10 to open or close the freezing compartment.

Meanwhile, as exemplarily shown in FIG. 2, a storage space in which food may be stored, i.e. the refrigerating compartment 2 is defined in the cabinet 10. Although the present embodiment mainly describes the refrigerating compartment for convenience of description, the present embodiment is not limited to the refrigerating compartment and may be applied to any other storage space, such as, for example, the freezing compartment so long as it may store food and the like therein. Therefore, for convenience, the storage space is referred to as "first storage region".

In the present embodiment, there is provided a container 100 that defines a storage compartment 52 (hereinafter referred to as "second storage region" for convenience) separate from the first storage region 2. The container 100 is rotatable relative to the door 20. That is, the container 100 is a separate component that is operated independently of the cabinet 10 and the door 20.

Hereinafter, a relationship of the cabinet 10, the door 20 and the container 100 and configurations of the same will be described in detail with reference to FIG. 2. FIG. 2 shows a state in which the container 100 is received in the cabinet 10 and the door 20 is opened alone.

The door 20 is pivotally rotatably coupled to the cabinet 10 via the first hinge member 40. The first hinge member 40 is located at one side of the cabinet 10. The door 20 is pivotally rotatable about a rotating shaft 42 (hereinafter referred to as "first rotating shaft" for convenience) of the first hinge member 40 and may open or close the first storage region 2.

A gasket 26 is attached to an inner surface of the door 20. The gasket 26 is located along a rim of the door 20. The gasket 26 may generally take the form of a rectangular band conforming to a rectangular shape of the door 20. Once the door 20 is rotated toward the cabinet 10 to hermetically seal the first storage region 2, the gasket 26 comes into contact with a front surface portion 12 of the cabinet 10, thus functioning to prevent leakage of cold air from the first storage region 2.

Meanwhile, the container 100 is pivotally rotatably coupled to the door 20 via a second hinge member 200. A rotating shaft (hereinafter referred to as "second rotating shaft" for convenience) of the second hinge member 200 is located at the door 20 and is separate from the first rotating shaft 42 of the first hinge member 40. That is, the first hinge member 40 is interposed between the cabinet 10 and the door 20 and the second hinge member 200 is interposed between the door 20 and the container 100.

Hereinafter, for convenience of description, the terms "up-and-down direction", "left-and-right direction" and "front-and-rear direction" as described in FIG. 2 are used. Preferably, dimensions of the container 100 (a left-and-right direction length (width) and an up-and-down direction length (height)) must substantially be at least not greater than those of the first storage region 2 such that the container 100 is received in the first storage region 2. A depth (front-and-rear direction length) of the container 100 preferably occupies a predetermined part of a depth of the first storage region 2. Through this configuration, when the door 20 is closed, the container 100 is placed in the first storage region 2 and, therefore, leakage of cold air may occur only through a gap between the front surface portion 12 of the cabinet 10 and an inner rim portion of the door 20. Thus, it is possible to prevent leakage of cold air by simply attaching the single gasket 26 to the inner rim portion of the door 20. Accordingly, in the present embodiment, the gasket 26 for the door 20 may be sufficient without requiring a gasket for the container 100. In this way, according to the present invention, it is possible to effectively prevent loss of cold air due to installation of a number of gaskets, waste of power required for heating and the like.

Meanwhile, a fastening device 600 to selectively couple the container 100 and the door 20 to each other is preferably installed to the door 20. More specifically, the fastening device 600 functions to couple the door 20 and the container 100 to each other when it is desired to open the door 20 and the container 100 together and also functions to release coupling of the door 20 and the container 100 when it is desired to open the door 20 alone. To implement coupling and release of the door 20 and the container 100 via the fastening device 600, the handle 22 is preferably provided with an operating unit.

Meanwhile, a storage member 24 for storage of food therein may be installed to the inner surface of the door 20. More specifically, after the door 20 is opened by the user as exemplarily shown in FIG. 2, the user may access the storage member 24 to store food in the storage member 24 installed to the inner surface of the door 20 or to retrieve the stored food. Of course, instead of providing the door 20 with the storage member 24, the container 100 may be increased in depth such that the container 100 uses a space occupied by the storage member 24 of the door 20.

Next, a case in which the door 20 and the container 100 are opened together will be described with reference to FIG. 3.

When the user who desires to use the first storage region 2 opens the door 20 and the container 100 together, the user can access the first storage region 2. The first storage region 2 may have substantially the same configuration as that of a storage compartment of a general refrigerator. For example, the first storage region 2 may contain a plurality of shelves 4 and drawers 6 and the like.

Meanwhile, the container 100 is preferably provided with a coupler 500 of a fixing device. The coupler 500 of the fixing device serves to selectively couple the container 100 to the cabinet 10. More specifically, the coupler 500 functions to couple the container 100 and the cabinet 10 to each other when it is desired to open the door 20 alone and also functions to release coupling of the container 100 and the cabinet 10 when it is desired to open the door 20 and the container 100 together.

The fixing device according to the present invention, as exemplarily shown in FIG. 6, may include a clasp installed to a first member and a coupler installed to a second member. In the refrigerator according to the present invention, the first member may correspond to the cabinet 10 and the second member may correspond to the container 100. Of course, although the first member and the second member may be replaced by any other separable components, in the present specification, for convenience of description, the first member is referred to as the cabinet 10 and the second member is referred to as the container 100.

Referring to FIG. 4, in one embodiment of the present invention, a clasp 400 is installed to an inner case 120 defining the first storage region 2. In this case, the clasp 400 protrudes downward from the top of the first storage region 2.

The clasp 400 is installed to the top of the inner case 120, i.e. at the top of the first storage region 2, which may prevent the clasp 400 from interfering with the user when the user retrieves food stored in the first storage region 2. Assuming that the clasp 400 is installed to the bottom or lateral side of the first storage region 2, the clasp 400 is easily visible by the user's eyes and the user may collide with the clasp 400 when retrieving food.

Referring to FIGS. 4 and 5, the coupler 500 is placed on the top of the container 100. Thus, the coupler 500 may come into contact with the clasp 400 while the container 100 is being introduced into the first storage region 2.

The coupler 500 is located at an upper end of the container 100, i.e. at a high height beyond the user's reach, which may prevent the user from unintentionally operating the coupler 500.

The coupler 500 may be switched from one state to the other state by coming into contact with the clasp 400, so as to be coupled to or released from the clasp 400. In this case, as the coupler 500 is coupled to the clasp 400, the container 100 is coupled to the cabinet 10. On the other hand, as the coupler 500 is released from the clasp 400, the container 100 is released from the cabinet 10 and is rotatable relative to the cabinet 10.

The coupler 500 may be installed to the container 100 at a position opposite to the second hinge member 200 (as shown in FIG. 3 in detail). The second hinge member 200 connects the container 100 to the door 20 and transfers force applied to the door 20 to the container 100. The coupler 500 may exert greater support force against force applied to the container 100 with increasing distance from the second hinge member 200. This is because torque is calculated by multiplying force by a distance from an application point of force. Thus, positioning the coupler 500 far from the second hinge member 200 may enhance coupling force of the container 100 and the cabinet 10 generated by the coupler 500.

FIG. 6 is a view showing the clasp and the coupler according to one embodiment of the present invention. A description with reference to FIGS. 6 and 7 is as follows. FIG. 7 is a sectional view taken along line A-A of FIG. 6.

The coupler 500 includes a first housing 502 forming an external appearance of a lower portion of the coupler 500 and a second housing 504 forming an external appearance of an upper portion of the coupler 500. As the second housing 504 is coupled to the container 100, the coupler 500 may be installed to the container 100.

The coupler 500 further includes a hook 510 configured to be vertically rotated toward the clasp 400 located thereabove. The hook 510 may be provided at one end thereof with a protruding tip portion 511. The protruding tip portion 511 may protrude upward from a body of the hook 510 by a predetermined height.

The protruding tip portion 511 may include a first slope 512 and a second slope 514, which come into contact with the clasp 400 to vary a position of the hook 510.

The first slope 512 may come into contact with the clasp 400 when the hook 510 is introduced into the clasp 400. On the other hand, the second slope 514 may come into contact with the clasp 400 as the hook 510 is moved away from the clasp 400.

In particular, the first slope 512 and the second slope 514 preferably have different inclination angles. That is, force required to move the container 100 by causing the first slope 512 and the clasp 400 to come into contact with each other preferably differs from force required to move the container 100 by causing the second slope 514 and the clasp 400 to come into contact with each other. In the present invention, coupling of the container 100 and the cabinet 10 is accomplished with less force, whereas release of coupling of the container 100 and the cabinet 10 is accomplished with great force.

The hook 510 may be rotated within the first housing 502 and the second housing 504 and be caught by the clasp 400.

The clasp 400 may include a first contact portion 402 which comes into contact with the hook 510 when the hook 510 begins to be caught by the clasp 400 and a second contact portion 404 which comes into contact with the hook 510 when the hook 510 begins to be released from the clasp 400. In this case, the first contact portion 402 and the second contact portion 404 may take the form of a plane and may have different inclination angles.

In this case, the first contact portion 402 and the second contact portion 404 in the form of a plane may guide the first slope 512 and the second slope 514 respectively in a planar direction thereof.

Due to the fact that the first contact portion 402 and the second contact portion 404 have different inclination angles, force required to move the container 100 by causing the hook 510 and the first contact portion 402 to come into contact with each other differs from force required to move the container 100 by causing the hook 510 and the second contact portion 404 to come into contact with each other.

Meanwhile, the coupler 500 further includes an elastic member 520 to elastically support the hook 510 such that the hook 510 is moved toward the clasp 400. In this case, the elastic member 520 may be a compression spring that is compressively deformable by external force.

That is, the elastic member 520 may be installed opposite to the clasp 400 on the basis of the hook 510. The elastic member 520 may provide force required to allow the hook 510 to be rotated toward the clasp 400.

In particular, a contact position between the protruding tip portion 511 and the clasp 400 may be spaced apart from a rotation center of the hook 510 by a predetermined distance d. That is, a height difference between one side of the hook 510, i.e. the protruding tip portion 511 coming into contact with the clasp 400 and the other side of the hook 510, i.e. the rotation center of the hook 510 corresponds to the predetermined distance d.

Assuming that the contact position between the protruding tip portion 511 and the clasp 400 and the rotation center of the hook 510 are positioned at the same height, the hook 510 cannot be rotated downward even if force to pull the hook 510 rightward (on the basis of FIG. 7) is applied. This is because there is no lever arm perpendicular to the rotation center of the hook 510 even if great force is applied and, thus, the hook 510 cannot be rotated. Thus, coupling of the cabinet 10 and the container 100 cannot be released because the hook 510 remains in a rotation impossible state and the protruding tip portion 511 and the clasp 400 remain in a contact state.

In addition, the hook 510 may be arranged so as to be tilted upward from a horizontal direction by a predetermined angle. That is, the hook 510 may be installed such that the protruding tip portion 511 is located higher than the rotation center of the hook 510. As such, even if the weight of the container 100 is increased due to food stored therein and, thus, the container 100 is slightly moved downward, the protruding tip portion 511 and the clasp 400 may come into contact with each other. Thereby, the container 100 and the cabinet 10 may be coupled to each other or released from each other by the fixing device.

FIGS. 7 to 10 are views showing operation according to one embodiment. A description with reference to FIGS. 7 to 10 is as follows.

When it is desired to open the door 20 and the container 100 together (in the state of FIG. 3), the user may pull the door 20 and the container 100 together. In this case, since the door 20 and the container 100 are coupled to each other via the fastening device 600, the user may move the container 100 by pulling the door 20.

When the user pulls the container 100 (rightward on the basis of FIG. 7), the second slope 514 of the hook 510 is temporarily caught by the second contact portion 404, thereby causing movement of the container 100 to stop. Then, when force required to allow the second slope 514 to escape from the second contact portion 404, i.e. force required to compress the elastic member 520 as exemplarily shown in FIG. 8 is applied, the elastic member 520 is compressed and a contact area between the second slope 514 and the second contact portion 404 is gradually reduced. Thereby, coupling of the clasp 400 and the coupler 500 may be released as exemplarily shown in FIG. 10.

In the state of FIG. 10, the user can access the first storage region 2 present at the left side of FIG. 10 by moving the container 100 and the door 20 together.

On the other hand, when it is desired to couple the container 100 and the cabinet 10 to each other, the user can rotate the container 100 toward the first storage region 2. In this case, an inverse operation of that in FIGS. 7 to 10 is implemented.

That is, as exemplarily shown in FIG. 10, the first slope 512 comes into contact with the first contact portion 402. The first slope 512 is tilted relative to the clasp 400 differently from the second slope 514. In addition, the first contact portion 402 is tilted relative to the coupler 500 differently from the second contact portion 404. As such, when the first slope 512 comes into contact with the first contact portion 402 to cause movement of the container 100, the container 100 may be moved with less force than that required to move the container 100 by causing the second slope 514 and the second contact portion 404 to come into contact with each other.

That is, since the first slope 512 and the first contact portion 402 are inclined, the elastic member 520 may be more compressed as a contact area between the first contact portion 402 and the first slope 512 increases. Once the elastic member 520 is sufficiently compressed and the hook 510 is moved until the clasp 400 does not interfere with the hook 510 as exemplarily shown in FIG. 8, the hook 510 is finally switched from the state of FIG. 8 to the state of FIG. 7, thereby being caught by the clasp 400.

In this way, the container 100 and the cabinet 10 may be coupled to each other.

More particularly, when the elastic member 520 moves the hook 510 to a maximum movement position, the coupler 500 and the clasp 400 may be switched from a coupled state to a released state. Likewise, when the elastic member 520 moves the hook 510 to a maximum movement position, the coupler 500 and the clasp 400 may be switched from a released state to a coupled state.

When the container 100 and the door 20 are rotated via the first hinge member 40, the container 100 and the door 20 are coupled to each other via the fastening device 600. In this case, force to rotate the door 20 applied by the user may be sufficiently transferred to the container 100 and, therefore, the coupler 500 may release the container 100 from the cabinet 10.

On the other hand, when coupling of the door 20 and the container 100 is released and the door 20 is rotated, the coupler 500 may continuously couple the container 100 to the cabinet 10.

Differently from the above-described case, the user may rotate the door 20 alone in a coupled state of the container 100 and the cabinet 10 (in the state shown in FIG. 2). In this case, the state of FIG. 7 is maintained. That is, to release coupling of the cabinet 10 and the container 100, as exemplarily shown in FIG. 8, it is necessary to provide the container 100 with force required to compress the elastic member 520. However, since the container 100 and the door 20 are not coupled to each other, no force is transferred to the container 100 even if the user pulls the door 20 to open the same. Thus, the container 100 is continuously coupled to the cabinet 10 as exemplarily shown in FIG. 7.

In particular, in the present invention, the hook 510 may remain at the same position between a state in which the coupler 500 is caught by the clasp 400 (as shown in FIG. 7) and a state in which the coupler 500 is released from the clasp 400 (as shown in FIG. 10). That is, a position of the hook 510 is variable in a state in which the hook 510 comes into contact with the clasp 400 and moves on the clasp 400 (as shown in FIGS. 8 and 9), but remains at the same position after being completely coupled to the clasp 400 or after being completely released from the clasp 400.

Accordingly, even if the user who has rotated the container 100 and is accessible to the coupler 500 unintentionally operates the hook 510, the hook 510 may return to a position shown in FIG. 7 or FIG. 10 by elastic restoration force of the elastic member 520 when external force applied by the user is removed. That is, even if unintentional user operation occurs, it has no negative effect on operation of the coupler 500.

In another embodiment of the present invention, operation similar to that of the above-described embodiment is implemented via components that implement functions similar to those of the above-described embodiment. Thus, only parts different from the above description or requiring supplementary explanation will be described below and the above description may be equally applied to other details.

FIG. 11 is a view showing a clasp according to another embodiment of the present invention and FIG. 12 is a view showing a state in which a coupler according to another embodiment of the present invention is installed to the container. Referring to FIGS. 11 and 12, in the secondly described embodiment, the clasp 400 may have a circular cross section and generally takes the form of a cylinder.

In addition, in the secondly described embodiment, the coupler 500 may be rotatable relative to the clasp 400 in the same horizontal plane.

FIG. 13 is a view showing the clasp and the coupler according to the secondly described embodiment of the present invention and FIG. 14 is a view showing operation according to the secondly described embodiment. A description with reference to FIGS. 13 and 14 is as follows.

The coupler 500 may include the hook 510 and the elastic member 520 to elastically support the hook 510. In this case, the elastic member 520 may support the hook 510 in a horizontally rotatable manner.

The hook 510 may have the first slope 512 and the second slope 514 and inclination angles of the first slope 512 and the second slope 514 may differ.

In addition, the clasp 400 may include the first contact portion 402 and the second contact portion 404. The clasp 400 generally has a cylindrical shape and, thus, tangents of the first contact portion 402 and the second contact portion 404 in relation to a circular cross section of the clasp 400 may have different inclination angles.

To couple the container 100 to the cabinet 10, the first slope 512 and the first contact portion 402 come into contact with each other such that the hook 510 compresses the elastic member 520. When the elastic member 520 is deformed to rotate the hook 510 to a desired position, the first slope 512 and the clasp 400 no longer come into contact with each other, thus causing the hook 510 to be caught by the clasp 400.

Similar to the above-described embodiment of the present invention, in the secondly described embodiment, the hook 510 may compress the elastic member 520 to release coupling of the hook 510 and the clasp 400 when force required to sufficiently rotate the hook 510 is applied to the hook 510.

On the other hand, to release the container 100 from the cabinet 10, the second slope 514 and the second contact portion 404 come into contact with each other such that the hook 510 compresses the elastic member 520. To rotate the hook 510 by compressing the elastic member 520 in a state in which the second slope 514 comes into contact with the second contact portion 404, the user must apply greater force than that required to rotate the hook 510 by compressing the elastic member 520 in a state in which the first slope 512 comes into contact with the first contact portion 402.

Referring to FIGS. 15 and 16, an alternative embodiment of the present invention and the above embodiment described with reference to FIG. 6 differ only in terms of the presence of a damper member. FIG. 16 is a sectional view taken along line B-B of FIG. 15. For reference, in FIG. 16, the cross section taken along line A-A with regard to the position of FIG. 6 is equal to FIG. 7.

Referring to FIGS. 15 and 16, a damper member 560 may be provided to prevent the hook 510 from being not caught by the clasp 400 by shock applied to the coupler 500 upon collision of the clasp 400 and the coupler 500 or by retroaction.

That is, the coupler 500 and the clasp 400 may collide each other when the user introduces the container 100 into the cabinet 10 with great force. A spring 562 installed to the damper member 560 may be compressed when the coupler 500 hits the clasp 400. That is, as the spring 562 is compressed, shock generated between the coupler 500 and the clasp 400 may be relieved.

FIG. 17 is a view showing a clasp of the fixing device according to a further embodiment of the present invention. A description with reference to FIG. 17 is as follows.

A clasp 1012 is installed to the top of the cabinet 10 so as to protrude inward of the first storage region 2. In this case, the clasp 1012 may protrude downward from the top of the cabinet 10.

The clasp 1012 may include a cylindrical protruding guide pin 1016 and a curved guide wall 1014 having a curved surface 1015. The guide pin 1016 may have a rounded surface.

The guide pin 1016 may take the form of a cylinder having a circular cross section. The guide pin 1016 may have a predetermined radius to achieve a given level of strength. The guide wall 1014 may guide operation of some components of the fixing device using the curved surface 1015 thereof. That is, some components of the fixing device may come into contact with the curved surface 1015 so as to be moved on the curved surface 1015.

The guide pin 1016 and the guide wall 1014 may be spaced apart from each other by a predetermined distance and some components of the fixing device may be arranged between the guide pin 1016 and the guide wall 1014.

FIG. 18 is a view showing the coupler according to the thirdly described embodiment, FIG. 19 is a left side view of FIG. 18, FIG. 20 is a right side view of FIG. 18 and FIG. 21 is an exploded perspective view of FIG. 18. A description with reference to FIGS. 18 to 21 is as follows.

The coupler 1500 may be selectively coupled to or released from the clasp 1012. In addition, the coupler 1500 may be installed to the top of the container 100. A position of the coupler 1500 is determined to ensure contact between the coupler 1500 and the clasp 1012.

The coupler 1500 may include a first hook 1510 surrounding one side of the clasp 1012 and a second hook 1520 surrounding the other side of the clasp 1012. More specifically, the first hook 1510 may be positioned to surround one side of the guide pin 1016 and the second hook 1520 may be positioned to surround the other side of the guide pin 1016.

The coupler 1500 includes a first housing 1502 installed to the container 100. In this case, a plurality of components may be installed to the first housing 1502 to come into contact with the clasp 1012 so as to be coupled to or released from the clasp 1012.

The first housing 1502 is fixed to one surface of the container 100. That is, the first housing 1502 protrudes from only one surface of the container 100 rather than penetrating the container 100.

The first hook 1510 and the second hook 1520 are installed to the first housing 1502.

The first hook 1510 is fixed to the first housing 1502. That is, the first hook 1510 remains stationary at a predetermined position relative to the first housing 1502 regardless of whether or not external force is applied to the coupler 1500.

The first hook 1510 may have a first seat surface 1512 that substantially comes into contact with the guide pin 1016. The first seat surface 1512 may be formed of a shock absorbing material to prevent breakage thereof or to endure shock caused by frequent contact with the guide pin 1016.

The first hook 1510 may be coupled to the first housing 1502 using a first screw 1504. In this case, the first screw 1504 may fix the first hook 1510 to prevent the first hook 1510 from being moved relative to the first housing 1502.

On the other hand, the second hook 1520 is installed to the first housing 1502 in a selectively rotatable manner.

The first housing 1502 is provided with a rotating shaft 1508 in the form of a cylindrical protrusion. The second hook 1520 has a hollow portion 1524 into which the rotating shaft 1508 may be inserted. The hollow portion 1524 has a cylindrical shape to enable rotation of the second hook 1520.

The second hook 1520 has a protruding portion configured to come into contact with the guide pin 1016. Thus, the second hook 1520 may generally have a "ㄱ"-shaped or "ㄷ"-shaped form.

Meanwhile, the second hook 1520 may be coupled to the rotating shaft 1508 using a second screw 1506. In this case, the second screw 1506 may allow the second hook 1520 to be rotatable while preventing the second hook 1520 from being separated from the rotating shaft 1508.

In particular, a first elastic member 1530 is installed to elastically support the second hook 1520 such that the second hook 1520 is rotatable to surround the guide pin 1016 by a predetermined angle. The first elastic member 1530 may be a torsion spring that is elastically deformed upon receiving torque and returns to an original shape thereof upon removal of external force via elastic restoration force thereof.

The first elastic member 1530 has one end 1534 fixed to the second hook 1520 and the other end 1532 fixed to the first hook 1510. Thus, the first elastic member 1530 may limit movement of the second hook 1520. More specifically, the first elastic member 1530 may apply elastic force to the second hook 1520 to enable clockwise rotation of the second hook 1520.

Alternatively, the end 1534 of the first elastic member 1530 may be fixed to the second hook 1520 and the other end 1532 of the first elastic member 1530 may be fixed to the first housing 1502. So long as the first elastic member 1530 guides movement of the second hook 1520, the end 1534 of the first elastic member 1530 may be fixed to the second hook 1520 and the other end 1532 of the first elastic member 1530 may be coupled to any one fixed component.

Once the second hook 1520 has been rotated by a predetermined angle, the first elastic member 1530 may apply force to the second hook 1520 to return the second hook 1520 to an original state thereof. However, in a state in which the second hook 1520 is rotated beyond the predetermined angle, the first elastic member 1530 cannot apply force to the second hook 1520 to return the second hook 1520 to an original state thereof. More specifically, the first elastic member 1530 applies elastic restoration force to enable clockwise rotation of the second hook 1520 once the second hook 1520 has been rotated by a predetermined angle, but cannot apply elastic restoration force to the second hook 1520 after the second hook 1520 is rotated beyond the predetermined angle.

The second hook 1520 may have a second seat surface 1521 that substantially comes into contact with the guide pin 1016. The second seat surface 1521 may be formed of a shock absorbing material to prevent breakage thereof or to endure shock due to frequent contact with the guide pin 1016.

Meanwhile, the second hook 1520 substantially does not come into contact with the door 20 because the second hook 1520 is located at one surface of the container 100. That is, the second hook 1520 may be operated while not coming into contact with the door 20.

FIG. 22 is a view showing operation of the fixing device in the state of FIG. 1 according to the thirdly described embodiment. A description with reference to FIG. 22 is as follows.

When the door 20 hermetically seals the first storage region 2 as exemplarily shown in FIG. 1, the container 100 is positioned as exemplarily shown in FIG. 2. In this case, the container 100 is completely covered with the door 20 and is invisible in the state of FIG. 1. In addition, the container 100 and the door 20 come into contact with each other.

The coupler 1500 is coupled to the clasp 1012. In this case, the guide pin 1016 is surrounded by the first hook 1510 and the second hook 1520.

In such a state, the container 100 may be fixed to the cabinet 10. In addition, as the door 20 comes into contact with the container 100 and prevents movement of the container 100, rotation of the container 100 is impossible.

However, the second hook 1520 may be rotated when force required to overcome elastic force of the first elastic member 530 is applied to the second hook 1520.

FIG. 23 is a view showing operation of the fixing device in the state of FIG. 2 according to the thirdly described embodiment. A description with reference to FIG. 23 is as follows.

Meanwhile, the user may rotate the door 20 alone as exemplarily shown in FIG. 2 to access the container 100 through the front of the container 100 or to access food stored inside the door 20. In this case, the container 100 remains fixed to the cabinet 10.

In this case, the user may use the above-described fastening device 600.

When the user opens the door 20 alone, the second hook 1520 remains in a fixed state rather than being rotated. This is because the door 20 and the container 100 are not coupled to each other and, thus, the door 20 cannot apply force to the container 100 so as to rotate the container 100 downward. That is, the container 100 may be fixed to the cabinet 10 because the guide pin 1016 is surrounded by the first hook 1510 and the second hook 1520.

In conclusion, when the user rotates the door 20 alone by the fastening device 600 in the state of FIG. 22, the coupler 1500 couples the container 100 to the cabinet 10. In this way, the container 100 may be continuously coupled to the cabinet 10 in a pivotally rotated state of the door 20.

FIG. 24 is a view showing operation of the fixing device in the state of FIG. 3 according to the thirdly described embodiment. A description with reference to FIG. 24 is as follows.

The user may simultaneously rotate the container 100 and the door 20 as exemplarily shown in FIG. 3.

In this case, in the state shown in FIG. 22, the door 20 and the container 100 are rotated together. This is because the door 20 and the container 100 are rotated together relative to the cabinet 10 by the first hinge member 40 while maintaining a distance therebetween. To simultaneously rotate the door 20 and the container 100, the user may operate the fastening device 600 in the above-described manner.

In the state of FIG. 22, the coupler 1500 couples the container 100 and the cabinet 10 to each other with slight force. That is, when the user applies force beyond torque of the first elastic member 1530 to the door 20 and the container 100, the second hook 1520 may be rotated.

In this case, the second hook 1520 may be rotated counterclockwise as the door 20 and the container 100 are moved downward because the guide pin 1016 is integrated with the cabinet 10 and remains stationary. In this case, the second hook 1520 comes into contact with the guide pin 1016 and is sufficiently rotated counterclockwise by the guide pin 1016. In particular, once the second hook 1520 is sufficiently rotated, the second hook 1520 no longer comes into contact with the guide pin 1016.

That is, the coupler 1500 is not fixed to the guide pin 1016 and, therefore, the user can access food stored in the first storage region 2 by rotating the container 100 and the door 20 together relative to the cabinet 10.

The user must rotate the door 20 and the container 100 to the state shown in FIG. 1 after retrieving food stored in the first storage region 2 or inserting food into the first storage region 2.

In this case, the second hook 1520 remains in a counterclockwise rotated state. This is because the first elastic member 1530 cannot apply elastic restoration force to the second hook 1520 once the second hook 1520 is rotated by a predetermined angle. As the first elastic member 1530 does not provide elastic restoration force, the second hook 1520 is rotated counterclockwise and remains stationary.

When the user rotates the door 20 and the container 100 inward of the first storage region 2, the second hook 1520 comes into contact with the curved surface 1015 of the guide wall 1014. In this case, as the user gradually rotates the container 100 upward, the second hook 1520 successively comes into contact with different portions of the curved surface 1015. As the second hook 1520 comes into contact with the curved surface 1015, the second hook 1520 may be rotated clockwise and be positioned as exemplarily shown in FIG. 22.

In particular, when the second hook 1520 comes into contact with the curved surface 1015 for a predetermined time and is rotated clockwise by a predetermined angle or more, the second hook 1520 may be easily rotated clockwise by elastic restoration force of the first elastic member 1530.

Of course, when force required to overcome elastic support force of the first elastic member 1530 is applied in the state of FIG. 24, the second hook 1520 cannot be rotated and, therefore, the coupler 1500 may be released from the clasp 1012.

The present invention should not be construed as limited to the embodiments set forth herein. It should be understood that various modifications can be made by those skilled in the art within the spirit and scope of the invention as defined by the claims and these modifications should not be understood independently of the technical sprit or prospect of the invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a fixing device and a refrigerator having the same.

The invention claimed is:

1. A refrigerator comprising:

a cabinet defining a first storage region configured to store food;

a door rotatably connected to a first rotating shaft via a first hinge member to open and close the first storage region, the first rotating shaft provided at a front of the cabinet, and the door comprising a storage member that is mounted to a rear surface of the door and that is configured to store food;

a gasket provided at the door;

a container defining a second storage region, the second storage region configured to be received within the first storage region, the container being rotatably connected to a second rotating shaft via a second hinge member, the second rotating shaft being located at the door; and a fixing device configured to selectively couple the container to the cabinet, wherein the fixing device comprises:

a clasp provided on the cabinet, the clasp comprising a clasp contact portion defining a planar surface; and a coupler provided on the container, wherein the coupler comprises:

a hook comprising a protruding tip portion configured to contact the clasp contact portion, the hook being rotatable and the clasp contact portion being configured to catch the protruding tip portion of the hook based on the protruding tip portion of the hook contacting the clasp contact portion;

a damper member configured to absorb a shock that is caused by the coupler contacting the clasp;

a spring configured to apply a force that pushes the damper member in a direction toward the clasp;

an elastic member configured to elastically support the hook, the elastic member being arranged to enable the hook to rotate toward the clasp; and a hook contact portion of the protruding tip portion of the hook that is configured to contact the clasp contact portion based on the coupler and the clasp being coupled, wherein the hook contact portion is spaced apart from a rotation center of the hook by a predetermined distance.

2. The refrigerator according to claim 1, wherein the fixing device is configured to release the container from the cabinet in a state in which the container and the door are rotated together, relative to the cabinet, via the first hinge member.

3. The refrigerator according to claim 1, wherein the fixing device is configured to release the container from the cabinet in a state in which the container and the door are coupled to each other and are rotated together relative to the cabinet.

4. The refrigerator according to claim 1, wherein the fixing device is configured to maintain a coupling between the container and the cabinet in a state in which the door is rotated relative to the cabinet and a coupling between the door and the container is released.

5. The refrigerator according to claim 1, wherein the clasp is provided at a top portion of the first storage region, and wherein the coupler is provided at a top portion of the container.

6. The refrigerator according to claim 1, wherein the coupler is provided on the container at a position opposite to a position at which the second hinge member is provided.

7. The refrigerator according to claim 1, wherein the elastic member is configured to be compressed based on a force greater than or equal to a predetermined magnitude being horizontally applied to the hook, thereby causing the hook to be rotated about the rotation center of the hook.

8. The refrigerator according to claim 1, wherein the hook contact portion of the protruding tip portion of the hook is located at a vertical position that is higher than a vertical position of the rotation center of the hook by a predetermined distance.

9. The refrigerator according to claim 8, wherein the hook is tilted upward relative to a horizontal plane by a predetermined angle.

10. The refrigerator according to claim 1, wherein the protruding tip portion of the hook of the coupler comprises:

a first sloped portion configured to contact the clasp in a state in which the protruding tip portion begins to be caught by the clasp; and a second sloped portion configured to contact the clasp in a state in which the protruding tip portion is released from the clasp.

11. The refrigerator according to claim 10, wherein an inclination angle of the first slope portion is different from an inclination angle of the second slope portion.

12. The refrigerator according to claim 1, wherein the clasp contact portion of the clasp comprises:

a first clasp contact portion configured to contact the hook in a state in which the hook begins to be caught by the clasp; and a second clasp contact portion configured to contact the hook in a state in which the hook begins to be released from the clasp.

13. The refrigerator according to claim 12, wherein an inclination angle of the first clasp contact portion is different from an inclination angle of the second clasp contact portion.

14. The refrigerator according to claim 1, wherein the damper member is configured to, in a state in which the coupler contacts the clasp, apply a force that pushes the coupler in a direction away from the clasp.

15. The refrigerator according to claim 1, wherein the first rotating shaft and the second rotating shaft are parallel to each other.

* * * * *